US010336349B2

(12) United States Patent
Morin et al.

(10) Patent No.: US 10,336,349 B2
(45) Date of Patent: Jul. 2, 2019

(54) RAILROAD CAR TRUCK WITH WARP RESTRAINTS

(71) Applicant: STANDARD CAR TRUCK COMPANY, Rosemont, IL (US)

(72) Inventors: Andrew J. Morin, Mokena, IL (US); Ronald D. Golembiewski, Chicago, IL (US)

(73) Assignee: Standard Car Truck Company, Rosemont, IL (US)

( * ) Notice: Subject to any disclaimer, the term of this patent is extended or adjusted under 35 U.S.C. 154(b) by 228 days.

(21) Appl. No.: 15/363,599

(22) Filed: Nov. 29, 2016

(65) Prior Publication Data

US 2017/0174232 A1 Jun. 22, 2017

Related U.S. Application Data

(60) Provisional application No. 62/270,331, filed on Dec. 21, 2015.

(51) Int. Cl.

| | |
|---|---|
| ***B61F 5/12*** | (2006.01) |
| ***B61F 5/06*** | (2006.01) |
| ***B61F 5/38*** | (2006.01) |

(52) U.S. Cl.

CPC ..... *B61F 5/06* (2013.01); *B61F 5/12* (2013.01); *B61F 5/38* (2013.01)

(58) Field of Classification Search

CPC ..... B61F 5/04; B61F 5/40; B61F 5/42; B61F 5/52; B61F 5/122; B61F 5/50; B61F 5/12; B61F 5/14; B61F 5/34; B61F 5/06

See application file for complete search history.

(56) References Cited

U.S. PATENT DOCUMENTS

| | | | | |
|---|---|---|---|---|
| 1,414,962 A * | 5/1922 | Kadel | B61F 5/40 105/179 |
| 2,696,176 A * | 12/1954 | Dath | B61F 5/122 105/198.2 |
| 4,244,298 A | 1/1981 | Hawthorne et al. | |
| RE31,008 E * | 8/1982 | Barber | B61F 5/122 105/198.4 |

(Continued)

OTHER PUBLICATIONS

Korean Intellectual Property Office as International Searching Authority, International Search Report and Written Opinion, dated Mar. 21, 2017, in co-pending PCT Application No. PCT/US2016/065819 (17 pages).

*Primary Examiner* — Mark T Le

(74) *Attorney, Agent, or Firm* — Neal, Gerber & Eisenberg LLP

(57) ABSTRACT

A railroad car truck including a first side frame, a second side frame, a bolster, and a first plurality of warp restraints, each first warp restraint configured to reduce, inhibit, or minimize warping of the bolster relative to the side frame, and in one embodiment including a first inner bearing race at a first end of the bolster, a second opposing outer bearing race at the first side frame, and a roller positioned in a channel formed by and between the first and second opposing bearing races, and a second plurality of warp restraints, each second warp restraint including a first inner bearing race at a second end of the bolster, a second opposing outer bearing race at the second side frame, and a roller positioned in a channel formed by and between the first and second opposing bearing races.

35 Claims, 19 Drawing Sheets

(56) References Cited

U.S. PATENT DOCUMENTS

| | | | |
|---|---|---|---|
| 4,793,720 | A | 12/1988 | Merker, Jr. |
| 4,917,021 | A | 4/1990 | Murphy |
| 5,107,773 | A | 4/1992 | Daley et al. |
| 5,682,822 | A | 11/1997 | Sunderman et al. |
| 5,806,435 | A | 9/1998 | Pitchford |
| 6,142,082 | A | 11/2000 | Burke et al. |
| 6,817,301 | B1 | 11/2004 | Bullock |
| 7,665,622 | B2 | 2/2010 | Anderson et al. |
| 2004/0221763 | A1 | 11/2004 | Wike |
| 2004/0261652 | A1 | 12/2004 | Berg et al. |
| 2007/0169663 | A1 | 7/2007 | Berg et al. |

* cited by examiner

RAILROAD CAR TRUCK WITH WARP RESTRAINTS

PRIORITY CLAIM

This application claims priority to and the benefit of U.S. Provisional Patent Application Ser. No. 62/270,331, filed Dec. 21, 2015, entitled RAILROAD CAR TRUCK WITH WARP RESTRAINTS, the entire contents of which are incorporated herein by reference.

BACKGROUND

Conventional freight railroad cars in North America and other parts of the world typically include a car body and two spaced apart trucks. The car body or car body under frame typically includes two spaced apart center plates that respectively rest on and are rotatably or swivelly received by bolster bowls of the two trucks. The trucks rollingly support the car body along railroad tracks or rails. Each truck typically has a three piece truck configuration that includes two spaced apart parallel side frames and a bolster. The side frames extend in the same direction as the tracks or rails, and the bolster extends transversely or laterally to the tracks or rails. The bolster extends laterally through and between and is supported by the two spaced apart side frames. Each side frame typically defines a center opening and pedestal jaw openings on each side of the center opening. Each end of each bolster is typically supported by a spring group positioned in the center opening of the side frame and supported by the lower portion of the side frame that defines the center opening.

Each truck also typically includes two axles that support the side frames, four wheels, and four roller bearing assemblies respectively mounted on the ends of the axles. The truck further typically includes four bearing adapters respectively positioned on each roller bearing assembly in the respective pedestal jaw opening below the downwardly facing wall of the side frame that defines the top of the pedestal jaw opening. The wheel sets of the truck are thus received in bearing adapters placed in leading and trailing pedestal jaws in the side frames, so that axles of the wheel sets are generally parallel to each other. The bearing adapters permit relatively slight angular displacement of the axles. The spring sets or groups permit the bolster to move somewhat with respect to the side frame, about longitudinal or horizontal, vertical, and transverse axes (and combinations thereof).

Directions and orientations herein refer to the normal orientation of a railroad car in use. Thus, unless the context clearly requires otherwise, the "longitudinal" axis or direction is substantially parallel to straight tracks or rails and in the direction of movement of the railroad car on the track or rails in either direction. The "transverse" or "lateral" axis or direction is in a horizontal direction substantially perpendicular to the longitudinal axis and the straight tracks or rails. "Vertical" is the up-and-down direction, and "horizontal" is a plane parallel to the tracks or rails including the transverse and longitudinal axes. A truck is considered "square" when its wheels are aligned on parallel rails and the axles are parallel to each other and perpendicular to the side frames. The "leading" side of the truck means the first side of a truck of a railroad car to encounter a turn; and the "trailing" side is opposite the leading side.

Existing trucks do not fully address the ever increasing and expected future demands for freight railroad car truck performance in the railroad industry. More specifically, while the various current known and commercially available three piece truck configurations meet current Association of American Railroads ("AAR") specifications, enhanced specifications are being developed by the AAR and it is expected that the current three piece truck configurations may not meet these new AAR specifications. These AAR enhanced specifications set forth or codify these continuing and ongoing demands in the railroad industry for improved freight railroad car truck performance to: (a) reduce railroad car component wear and damage such as wheel wear and damage; (b) reduce rolling resistance; (c) reduce fuel consumption; (d) reduce the need for and thus cost of railroad track or rail repair (including reducing the cost of rail and tie maintenance); (e) reduce truck hunting and improve high speed stability ("HSS") for both empty and loaded railroad cars; and (f) improve curving performance for both empty and loaded railroad cars.

Ideally, on straight tracks or straight rails, a three piece truck with parallel side frames and parallel wheel set axles perpendicular to the side frames (i.e., a perfectly "square" truck) rolls without inducing lateral or transverse forces between the wheel tread and the rail. However, at higher speeds, even minor imperfections or perturbations in the tracks or rails or in the equipment can lead to a condition known as "hunting" that refers to a yawing or oscillating lateral movement of the wheel sets along the tracks or rails that causes the railroad car to move side-to-side on the tracks or rails. More than minor imperfections or perturbations in the tracks or rails or in the railroad car equipment or components can lead to greater truck hunting even at lower speeds. Hunting tends to increase wheel wear and damage, increase fuel consumption, increase the need for railroad track or rail repair, and decrease HSS. In certain instances, hunting has also led to derailments, damage to the lading, and damage to the freight railroad cars.

Curved railroad tracks or rails pose a different set of challenges for the standard three-piece truck. When a railroad car truck encounters a curve or turn, the distance traversed by the wheels on the outside of the curve is greater than the distance traversed by wheels on the inside of the curve, resulting in lateral and longitudinal forces between the respective wheels and the tracks or rails. These wheel forces often cause the wheel set to turn in a direction opposing the curve or turn. On trucks with insufficient rigidity, this can result in a condition variously known as "warping," "lozenging," "parallelogramming," and/or "unsquaring," wherein the side frames remain parallel, but one side frame moves forward with respect to the other side frame. This condition is referred to herein as warping for brevity.

Another known issue relates to various known three piece railroad truck suspensions that have side frames with flat rectangular surfaces against which friction wedges are pressed to produce frictional (i.e., Coulomb) damping to control vertical bounces and other oscillatory modes. Normally, significant clearance exists between the side frame's column face and nearby surfaces of the bolster to enable assembly and proper relative motion during use. This clearance is undesirable in that it enables the truck assembly to become warped or change shape from the intended parallel and perpendicular arrangement (i.e., to undergo warping).

Such warping (alone or in combination with hunting) can cause increased wear on the tracks or rails and railroad car truck components or equipment. Such warping (alone or in combination with hunting) also tends to increase rolling resistance that increases railroad car fuel consumption, decreases railroad car efficiency, and increases railroad engine pollution.

Accordingly, there is a need to meet these ongoing demands in the railroad industry for improved freight railroad car truck performance that reduces, inhibits, and/or minimizes warping.

SUMMARY

Various embodiments of the present disclosure provide a new railroad car, and more particularly a new railroad car truck with warp restraints that minimizes or solves the above warping related problems.

In various embodiments, the railroad car truck with warp restraints of the present disclosure includes a first side frame, a second side frame, a bolster, and a plurality of warp restraints. In various embodiments, each warp restraint includes a first inner bearing race connected to or integrally formed as part of the bolster, a second opposing inner bearing race connected to or integrally formed as part of the side frame, and a roller positioned in a channel formed by and between these first and second opposing bearing races. In various embodiments, the warp restraints including the independent rollers are each positioned at the inner and outer edges of the two column faces of each side frame to co-act to reduce, inhibit, or minimize warping of the railroad car truck of the present disclosure. More specifically, in various embodiments, the railroad car truck of the present disclosure has eight such warp restraints including: (1) a first plurality or set of warp restraints at a first end portion of the bolster and at the first side frame; and (2) a second plurality or set of warp restraints at a second end portion of the bolster and at the second side frame. In the first plurality of warp restraints, each first warp restraint includes a first inner bearing race connected to or integrally formed with a first end portion of the bolster, a second opposing inner bearing race connected to or integrally formed with the first side frame, and a roller positioned in a channel formed by and between these first and second opposing bearing races. In the second plurality of warp restraints, each second warp restraint includes a first inner bearing race connected or integrally formed with a second end portion of the bolster, a second opposing inner bearing race connected to or integrally formed with the second side frame, and a roller positioned in a channel formed by and between these first and second opposing bearing races. The present disclosure contemplates that the rollers may be of different shapes, sizes, and materials as further discussed in more detail below.

The rollers interact with the respective opposing bearing races to apply opposing forces to the side frames and bolster to reduce, inhibit, or minimize warping. More specifically, when the bolster moves from a square or perpendicular position relative to the side frames (or relative to each respective side frame), the respective warp restraints independently and in various groups or combinations co-act to apply opposing biasing forces to the bolster and the side frames to cause the bolster and/or side frames to move in the respective opposing direction and return to their normal square, perpendicular, or substantially perpendicular positions relative to each other, and thus co-act to reduce, inhibit, or minimize warping as further described below. It should also be appreciated that although the rollers or warp restraints of the present disclosure are not primarily intended to produce resistance against other directional movements of the bolster relative to the side frames, in various circumstances and embodiments, the warp restraints of the present disclosure can act or co-act to permit certain directional movements and act or co-act to reduce, inhibit, or minimize certain other directional movements alone or in combination with other components of the railroad car truck (such as friction wedges that provide vertical dampening or gibs that provide lateral restraint).

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1:
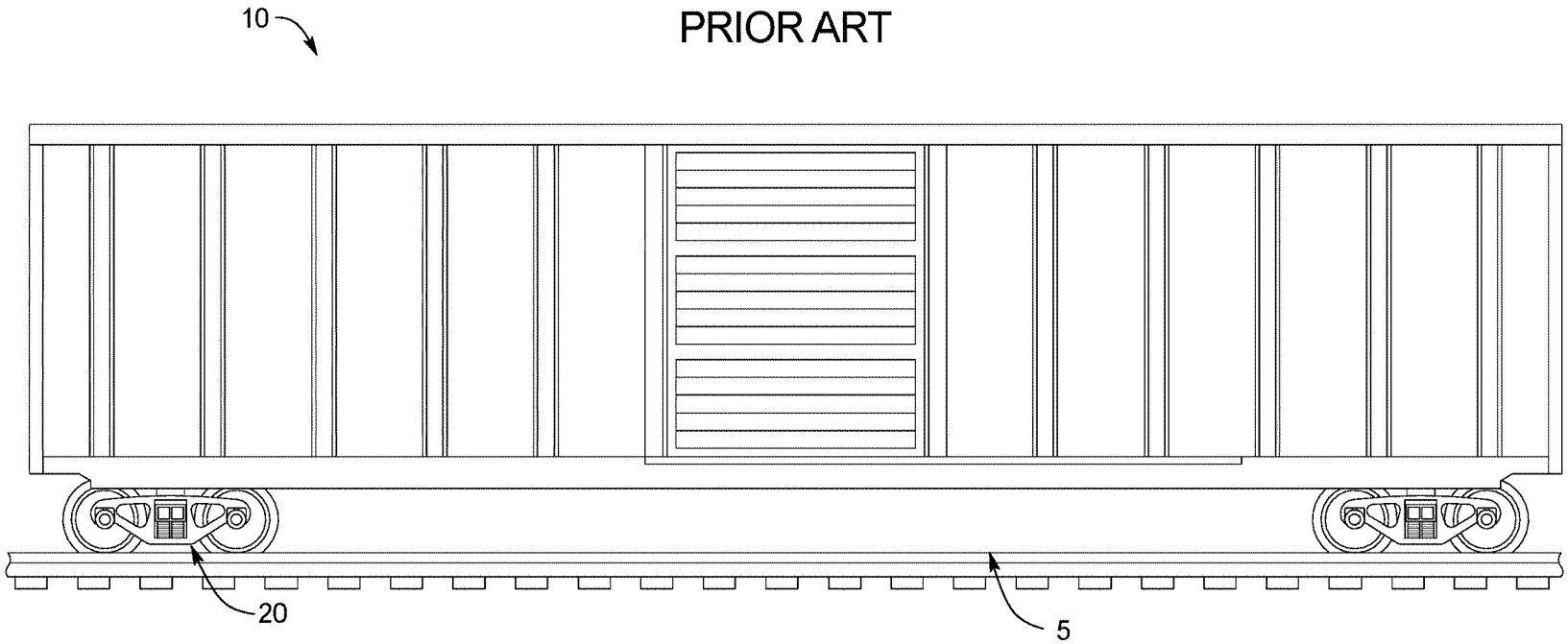
FIG. 1 PRIOR ART
FIG. 1 is a side view of a conventional freight railroad car positioned on conventional railroad tracks.
Figure 2:
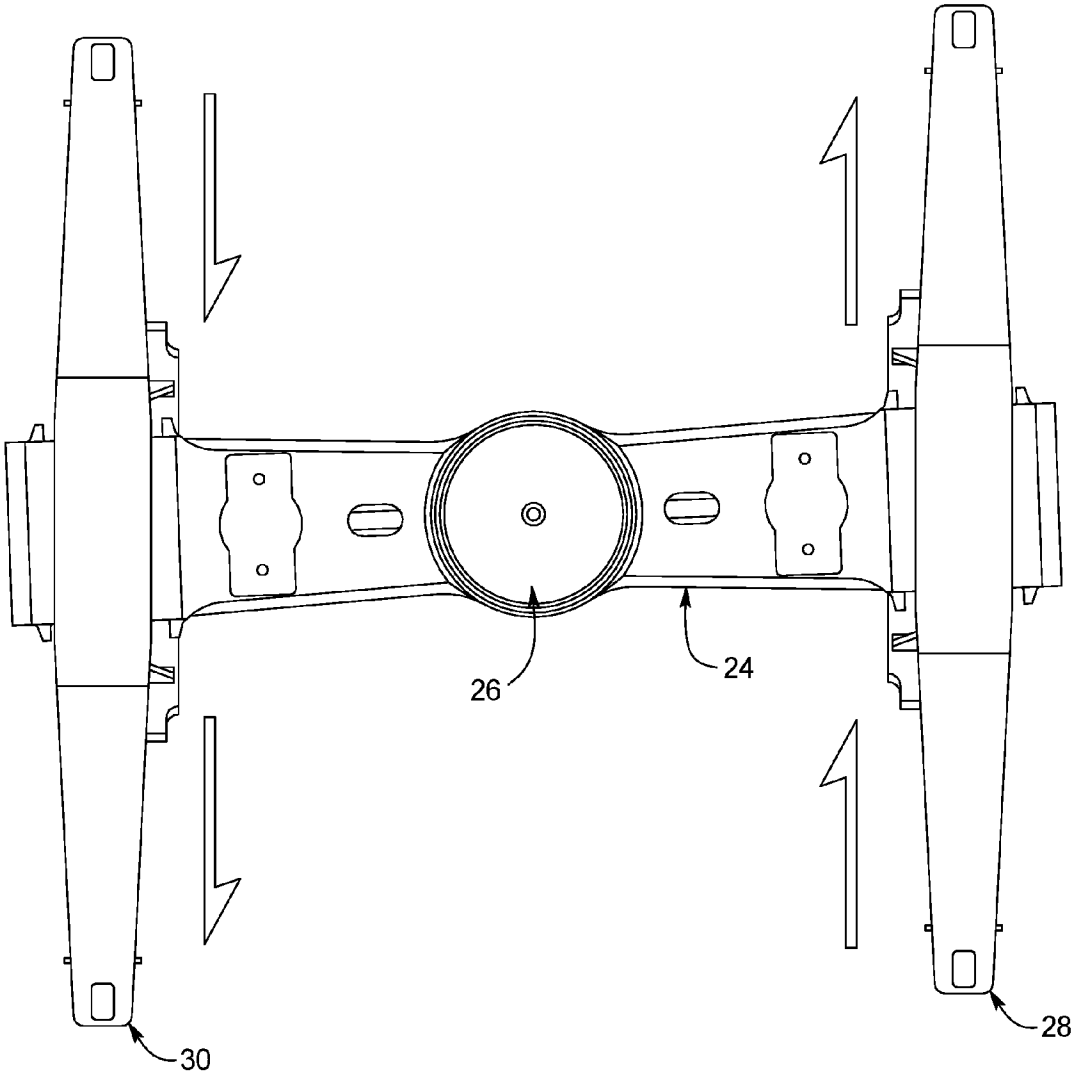
FIG. 2 PRIOR ART
FIG. 2 is top view of a bolster and two side frames of a conventional freight railroad car truck, and illustrating the bolster of the truck in a warped condition relative to the side frames of the truck.

Referring now to the drawings and particularly to FIGS. 1 and 2, a conventional railroad car truck that is generally indicated by numeral 20 and is shown with respect to a freight railroad car 10. The conventional railroad car truck is configured to roll along railroad tracks or rails 5. The conventional truck 20 includes a bolster 24, a bolster bowl 26 on the bolster 24, a first side frame 28, and a second side frame 30. Generally, the bolster 24 extends transversely to the direction of the railroad tracks or rails 5, and the side frames 28 and 30 extend longitudinally in the same direction as the railroad tracks or rails 5. As indicated by the arrows in FIG. 2 the side frames 28 and 30 are subject to warping where the side frames 28 and 30 remain parallel, but one side frame (such as side frame 28) moves forward with respect to the other side frame (such as side frame 30). When this occurs, the bolster 24 is not square with either of the side frames 28 or 30 and results in the above described problems.

Figure 3A:
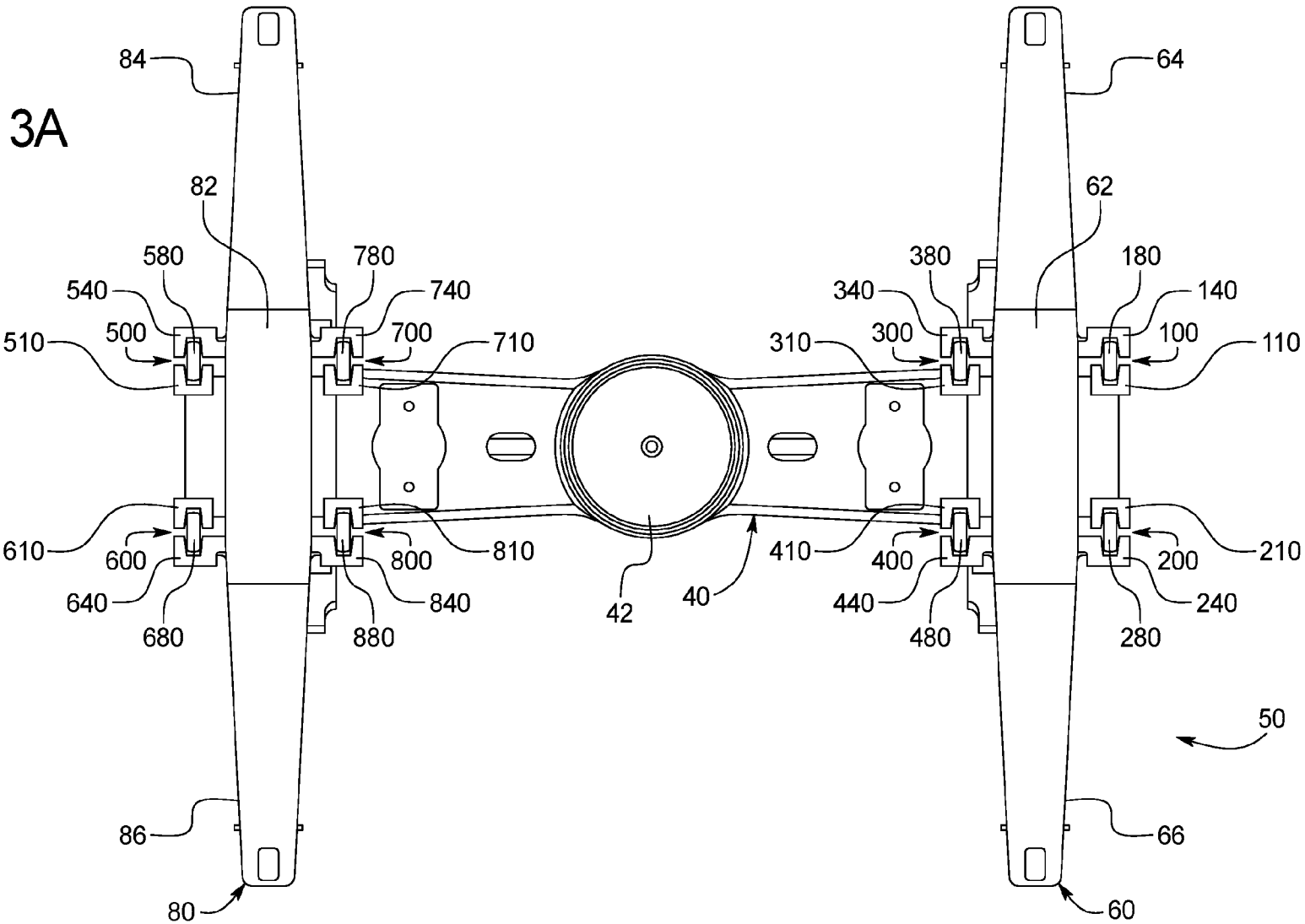
FIG. 3A is top view of a bolster, two side frames, and eight warp restraints of one example embodiment of the freight railroad car truck of the present disclosure, and illustrating the bolster in a square condition relative to the side frames.
Figure 3B:
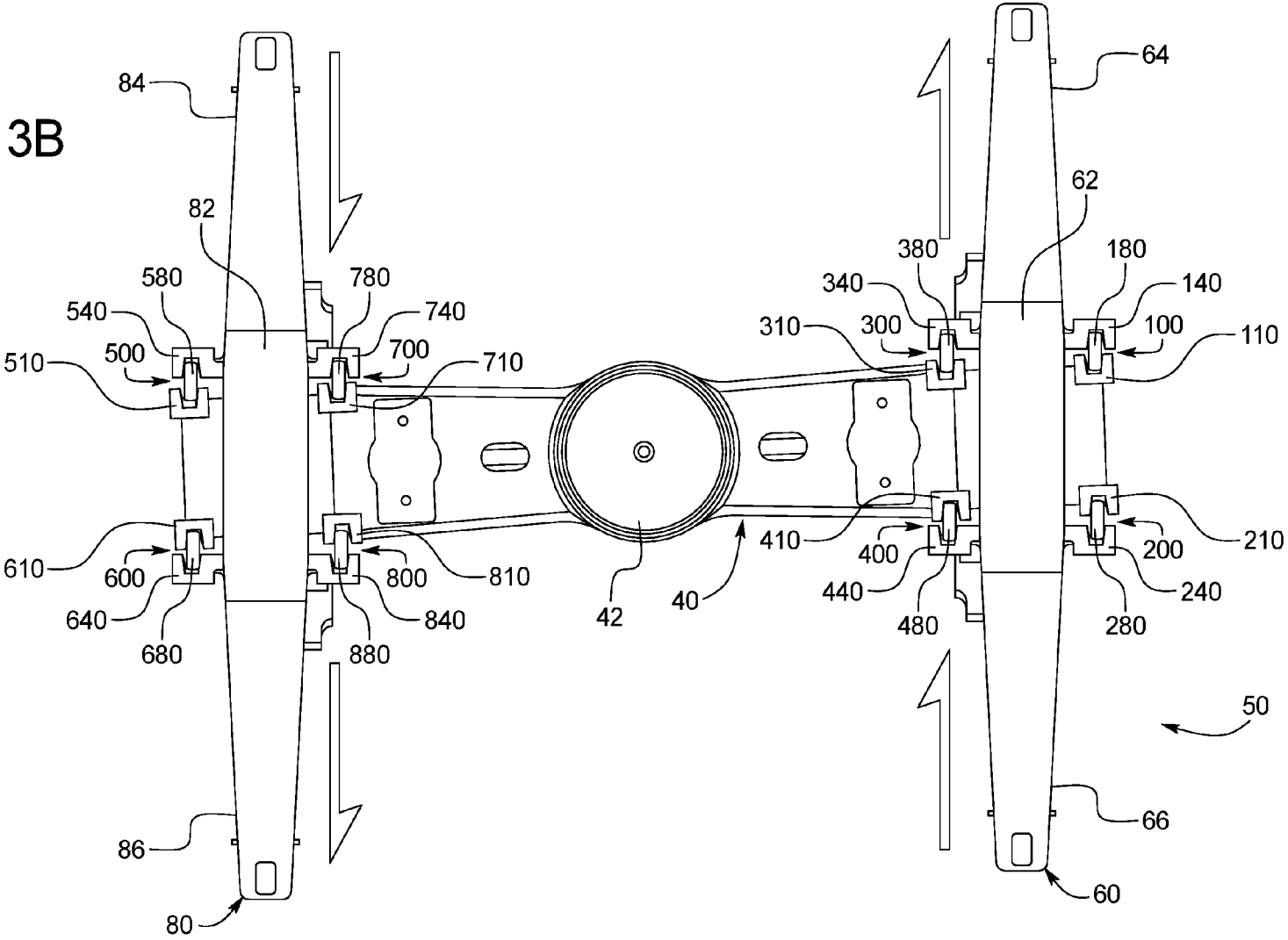
FIG. 3B is top view of a bolster, two side frames, and eight warp restraints of one example embodiment of the freight railroad car truck of the present disclosure, wherein the truck is in a warped position, and wherein certain of the warp restraints are applying biasing forces to urge the truck back to a square position.
Figure 4:
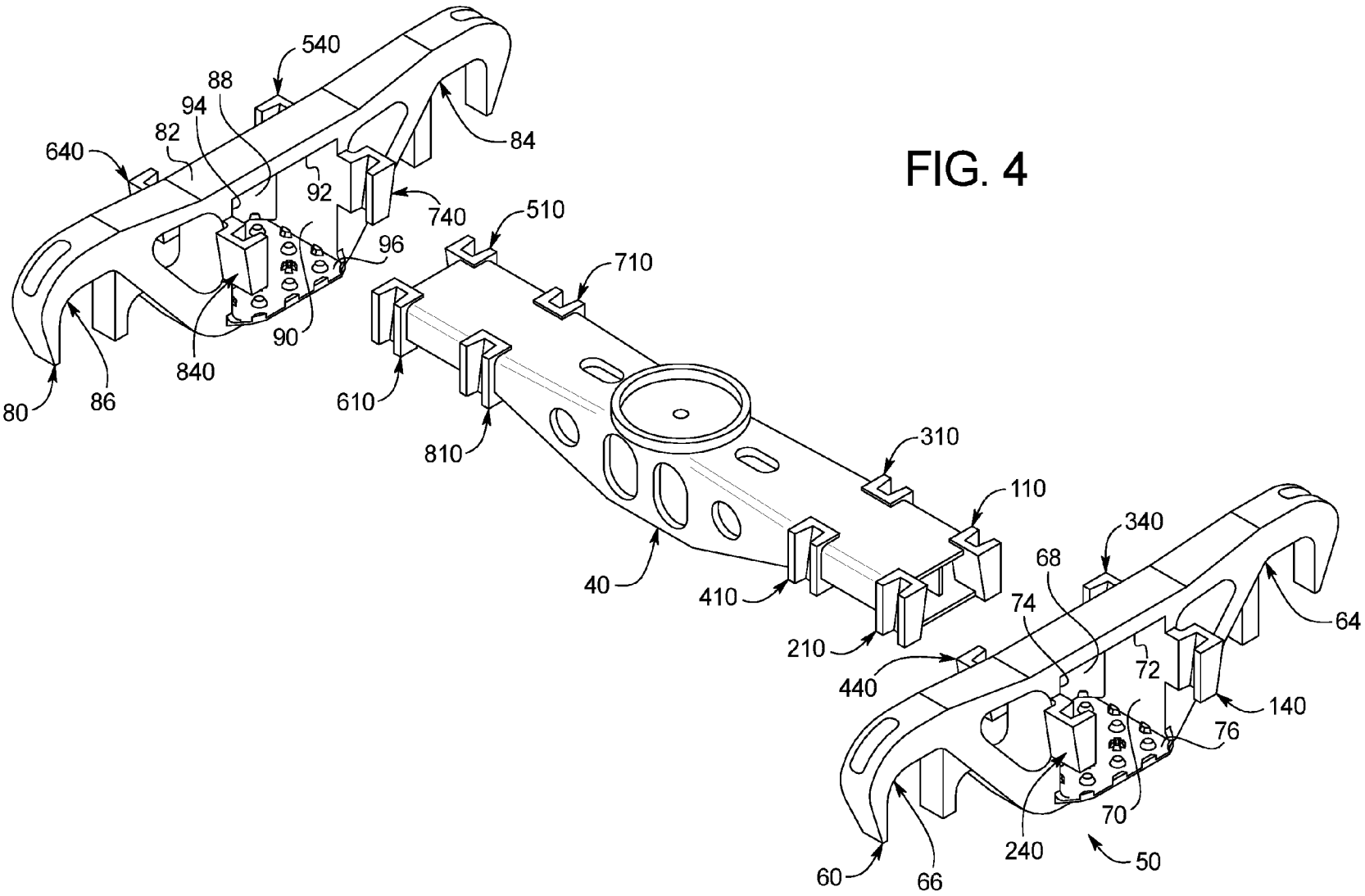
FIG. 4 is an exploded top perspective view of the bolster, two side frames, and eight warp restraints of the freight railroad car truck of FIG. 3A, and illustrating the inner bearing races of the warp restraints integrally cast with the bolster, and the outer bearing races of the warp restraints integrally cast with the respective side frames.
Figure 20:
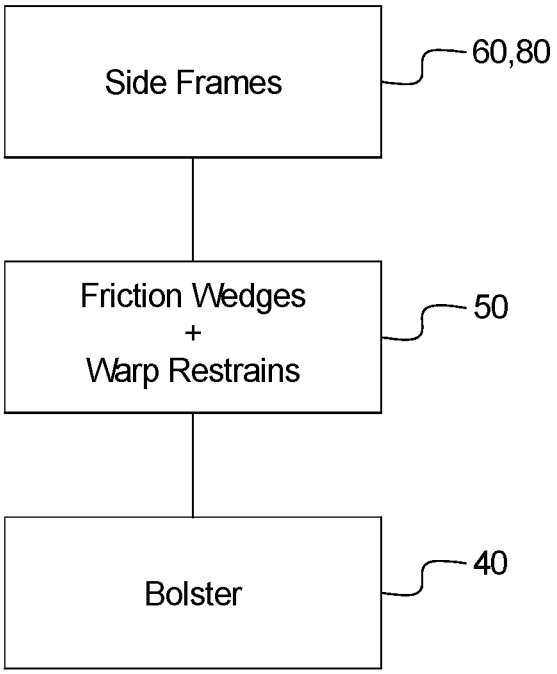
FIG. 20 is a diagramatic view of part of the railroad car of an example embodiment of the present disclosure.

Referring now to FIGS. 3A, 3B, 4, 5, 6, 7, 8, 9, 10, 11 and 12, and initially particularly FIGS. 3A, 3B, and 4, one embodiment of the railroad car truck with warp restraints of the present disclosure is shown and generally indicated by numeral 50. In this illustrated example embodiment of the present disclosure, the truck 50 includes a bolster 40, a bolster bowl 42 on the bolster 40, a first side frame 60, and a second side frame 80. Generally, the bolster 40 is configured to extend transversely to the direction of the railroad tracks or rails (not shown in FIG. 3A, 3B, or 4) and the side frames 60 and 80 are configured to extend longitudinally in the same direction as the railroad tracks (not shown in FIG. 3A, 3B, or 4). The side frame 60 includes a longitudinally extending body 62 and two downwardly extending pedestal jaws including a first pedestal jaw 64 and a second pedestal jaw 66 on opposite sides of a center opening 68 defined by the body 62 of the side frame 60. The body 62 includes a first side wall 70, a top wall 72, a second side wall 74, and a bottom wall 76 that generally define the opening 68. The side frame 80 includes a longitudinally extending body 82 and two downwardly extending pedestal jaws including a first pedestal jaw 84 and a second pedestal jaw 86 on opposite sides of the center opening 88 in the body 82 of the side frame 80. The body 82 includes a first side wall 90, a top wall 92, a second side wall 94, and a bottom wall 96 that generally define the opening 88. Alternatively in another embodiment, as shown in FIG. 20, friction wedges may be combined with warp restraints, such as combination 50', are configured to associate with side frames 60, 80 and bolster 40, to provide vertical damping.

In this illustrated example embodiment of the present disclosure, as best shown in FIGS. 3A, 3B, and 4, the railroad car truck with warp restraints 50 includes: (1) a first plurality or set of warp restraints 100, 200, 300, and 400; and (2) a second plurality or set of warp restraints 500, 600, 700, and 800. More specifically, in this illustrated embodiment, (a) warp restraint 100 includes a first inner bearing race 110 integrally formed at and extending from the first end portion of the bolster 40, a second opposing outer bearing race 140 integrally formed at and extending from the first side frame, and a roller 180 positioned in a channel formed by and between the first and second opposing bearing races 110 and 140; (b) warp restraint 200 includes a first inner bearing race 210 integrally formed at and extending from the first end portion of the bolster 40, a second opposing outer bearing race 240 integrally formed at and extending from the first side frame, and a roller 280 positioned in a channel formed by and between the first and second opposing bearing races 210 and 240; (c) warp restraint 300 includes a first inner bearing race 310 integrally formed at and extending from the first end portion of the bolster 40, a second opposing outer bearing race 340 integrally formed at and extending from the first side frame, and a roller 380 positioned in a channel formed by and between the first and second opposing bearing races 310 and 340; (d) warp restraint 400 includes a first inner bearing race 410 integrally formed at and extending from the first end portion of the bolster 40, a second opposing outer bearing race 440 integrally formed at and extending from the first side frame 60, and a roller 480 positioned in a channel formed by and between the first and second opposing bearing races 410 and 440; (e) warp restraint 500 includes a first inner bearing race 510 integrally formed at and extending from the second end portion of the bolster 40, a second opposing outer bearing race 540 integrally formed at and extending from the second side frame, and a roller 580 positioned in a channel formed by and between the first and second opposing bearing races 510 and 540; (f) warp restraint 600 includes a first inner bearing race 610 integrally formed at and extending from the second end portion of the bolster 40, a second opposing outer bearing race 640 integrally formed at and extending from the second side frame, and a roller 680 positioned in a channel formed by and between the first and second opposing bearing races 610 and 640; (g) warp restraint 700 includes a first inner bearing race 710 integrally formed at and extending from the second end portion of the bolster 40, a second opposing outer bearing race 740 integrally formed at and extending from the second side frame, and a roller 780 positioned in a channel formed by and between the first and second opposing bearing races 710 and 740; and (h) warp restraint 800 includes a first inner bearing race 810 integrally formed at and extending from the second end portion of the bolster 40, a second opposing outer bearing race 840 integrally formed at and extending from the second side frame 80, and a roller 880 positioned in a channel formed by and between the first and second opposing bearing races 810 and 840. Thus, bearing races 110, 210, 310, 410, 510, 610, 710, and 810 are integrally formed at and extend from the respective end portions of the bolster 40, bearing races 140, 240, 340, and 440 are integrally formed at and extend from the first side frame 60, and bearing races 540, 640, 740, and 840 are integrally formed at and extend from the second side frame 80.

It should be appreciated that each of the warp restraints 100, 200, 300, 400, 500, 600, 700, and 800 can be generally identical (except for positioning and arrangement of their connectors to, connections with, or formations with the side frames and the bolster). Therefore, warp restraint 100 is primarily discussed in further detail below. However, it should be appreciated that these warp restraints do not need to be identical and can vary based on the respective positions and connections to or formations with the side frames and the bolster. For example, the two bearing races of any single warp restraint may be different and specifically may have walls with different angles. This is somewhat illustrated when the example warp restraints of FIGS. 3A, 3B, 4, 5 and 6 are compared to the example warp restraints of FIGS. 10, 11, and 12. For brevity, the two different versions (with different bearing race wall angles) of warp restraint 100 are discussed in more detail with respect to FIGS. 5, 6, 7, 8, 9, 10, 11, and 12. It should also be appreciated that the rollers of the warp restraints are identical in the illustrated embodiment of to FIGS. 5, 6, 7, 8, 9, 10, 11, and 12, but may also be different and in particular may have different roller sizes such as roller diameters, roller thicknesses or widths, roller elasticity or spring characteristics, and roller shapes as partly illustrated in the alternative embodiments shown in FIGS. 13 and 14 and as further discussed in more detail below.

More specifically, example warp restraint 100 includes a first inner bearing race 110 integrally formed with the first end portion of the bolster 40, a second opposing outer bearing race 140 integrally formed with the first side frame 60, and a roller 180 positioned in a channel formed by and between the first and second opposing bearing races 110 and 140. It should be appreciated that the first inner bearing race 110 may be connected to the bolster 40 by a suitable first bearing race connector (not shown). It should also be appreciated that the second inner bearing race 140 may be connected to the bolster 40 by a suitable second bearing race connector such as connector 104 (best shown in FIG. 5).

Figure 5:
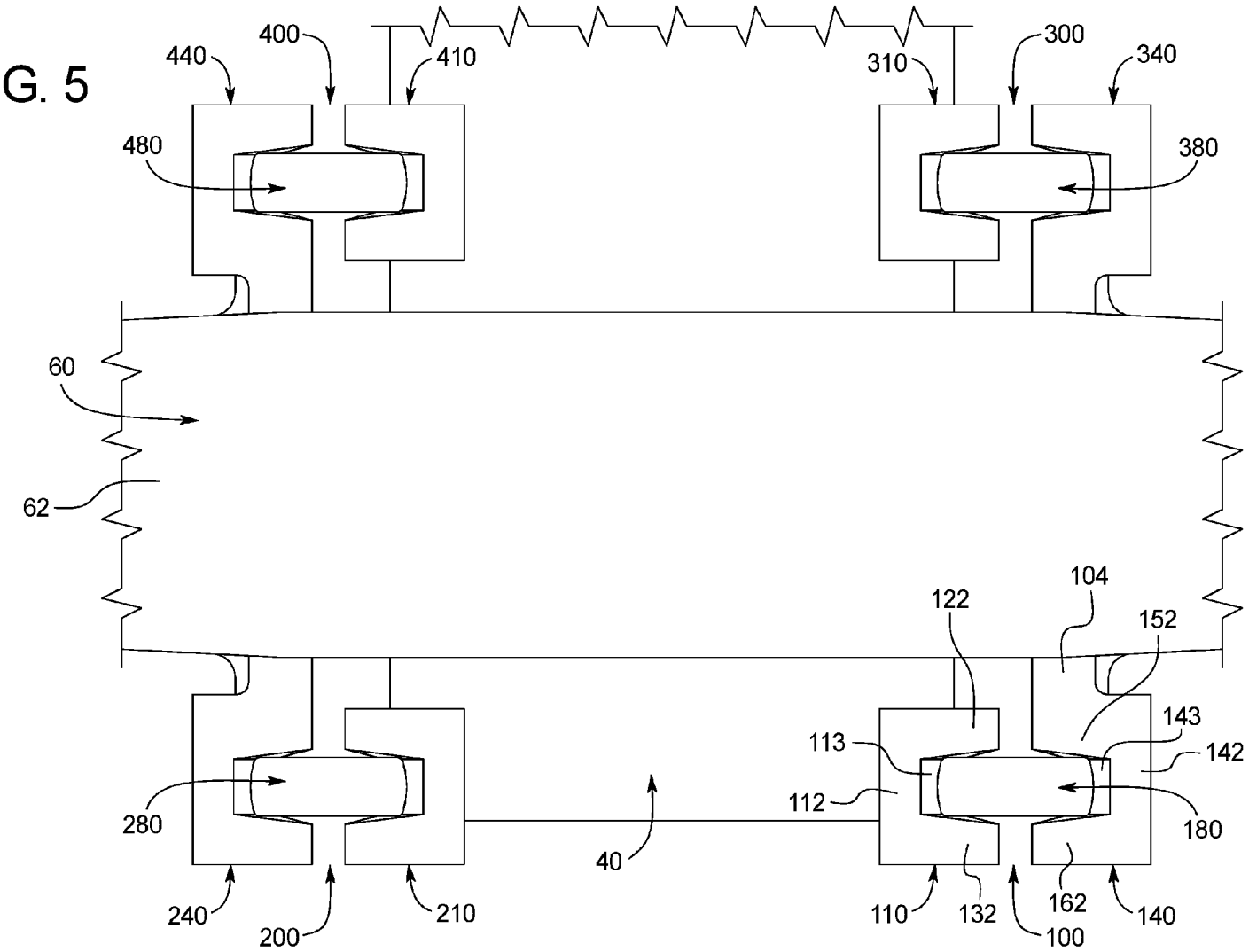
FIG. 5 is enlarged fragmentary top view one end portion of the bolster, a first one of the side frames, and a first one of the two sets of warp restraints of the freight railroad car truck of FIG. 3A.
Figure 6:
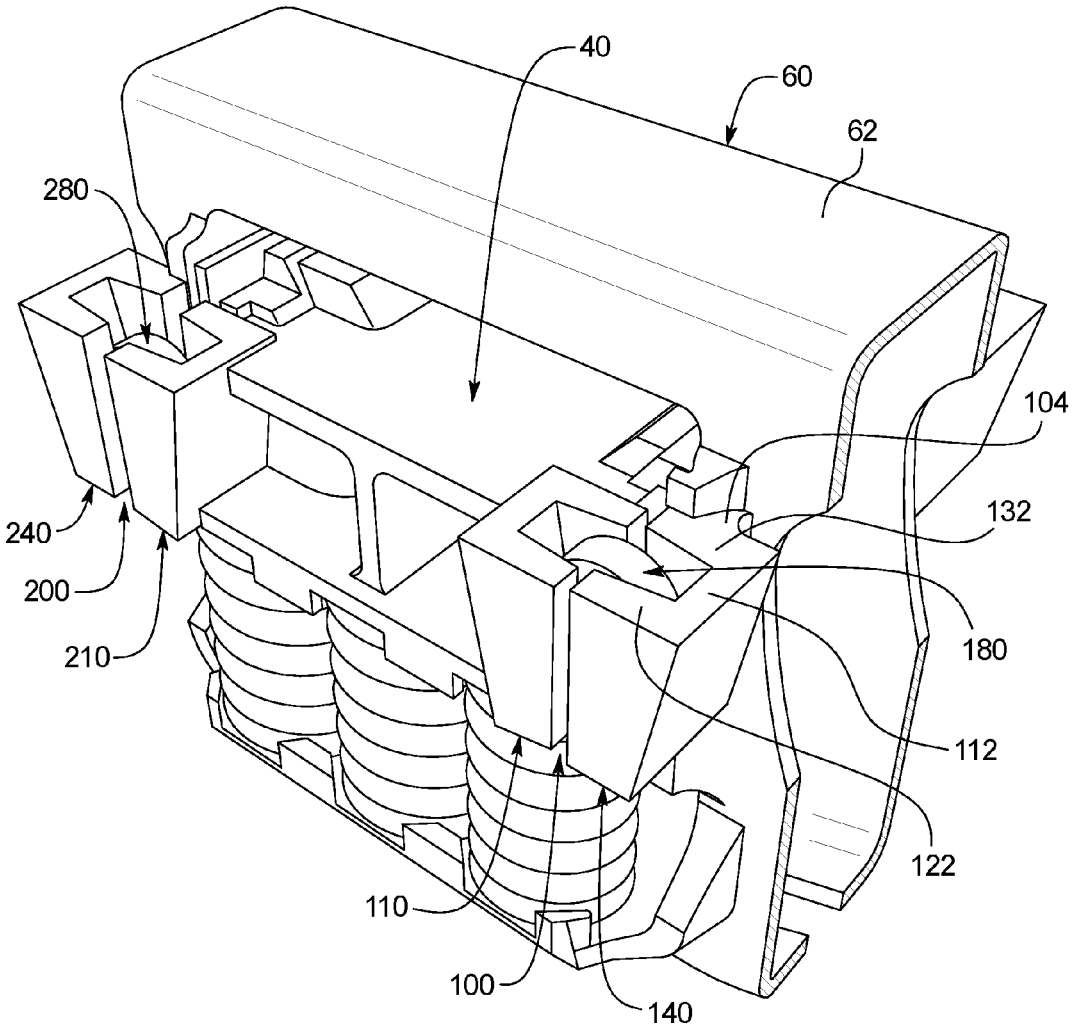
FIG. 6 is a fragmentary perspective view of one end portion of the bolster, a first one of the side frames, and two warp restraints of a first one of the sets of the warp restraints of the freight railroad car truck of FIG. 3A.
Figure 7:
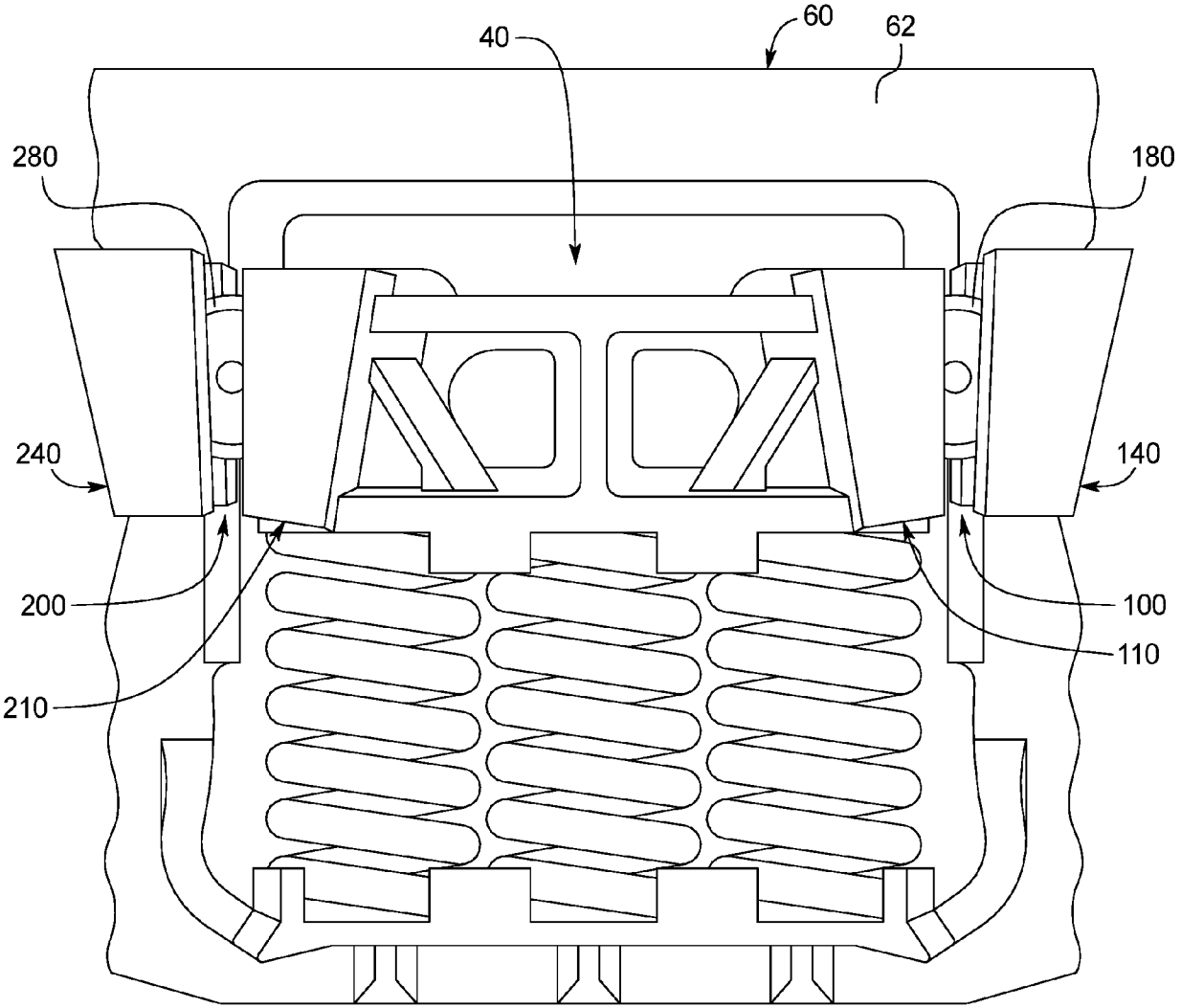
FIG. 7 is a fragmentary side view of one end portion of the bolster, a first one of the side frames, and two warp restraints of a first one of the sets of the warp restraints of the freight railroad car truck of FIG. 3A.
Figure 8:
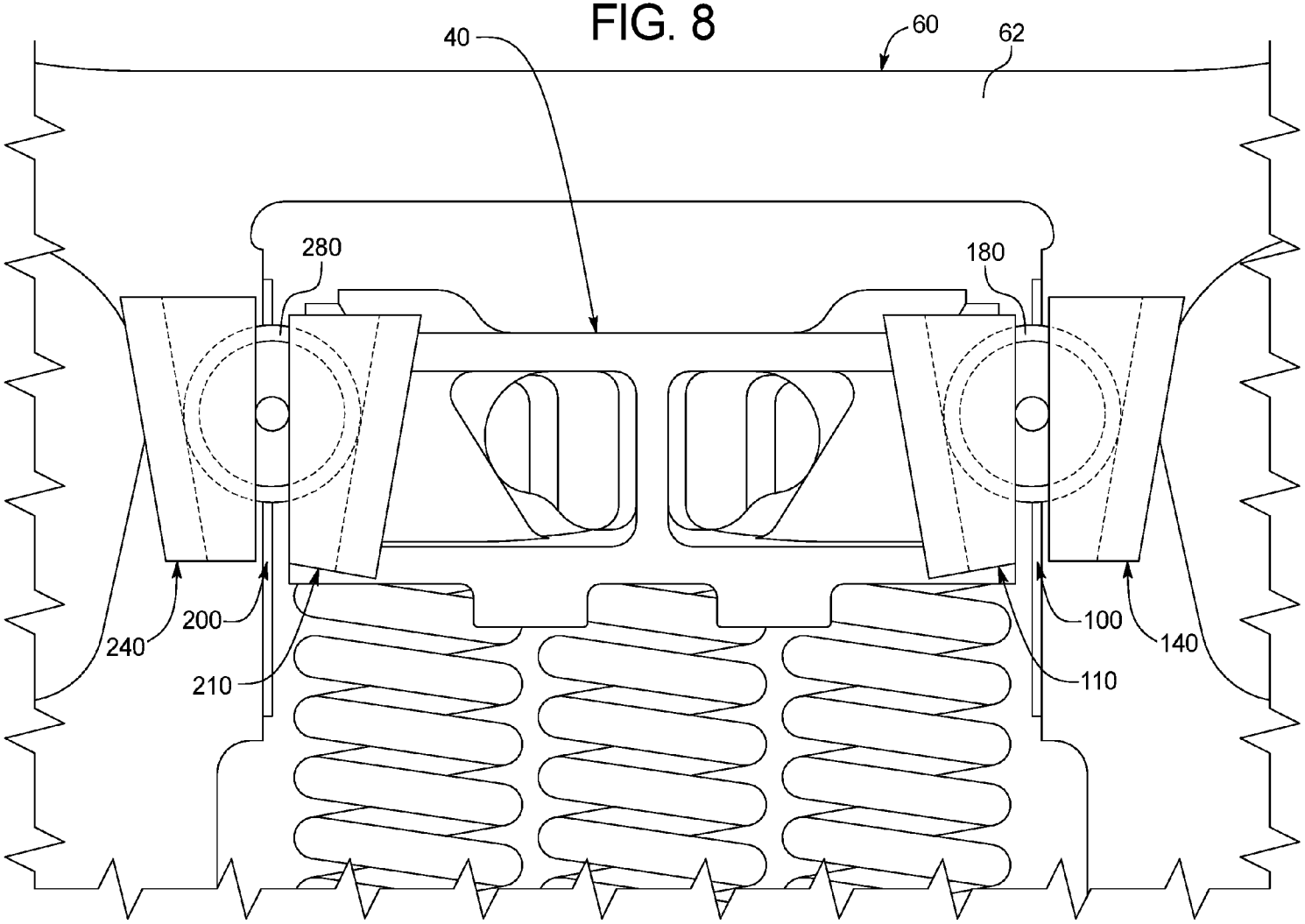
FIG. 8 is a fragmentary side view of one end portion of the bolster, a first one of the side frames, and two of the warp restraints of a first one of the sets of the warp restraints of the freight railroad car truck of FIG. 3A, wherein these two warp restraints are shown with inner walls of the bearing races in phantom and with the rollers partially in phantom.
Figure 9:
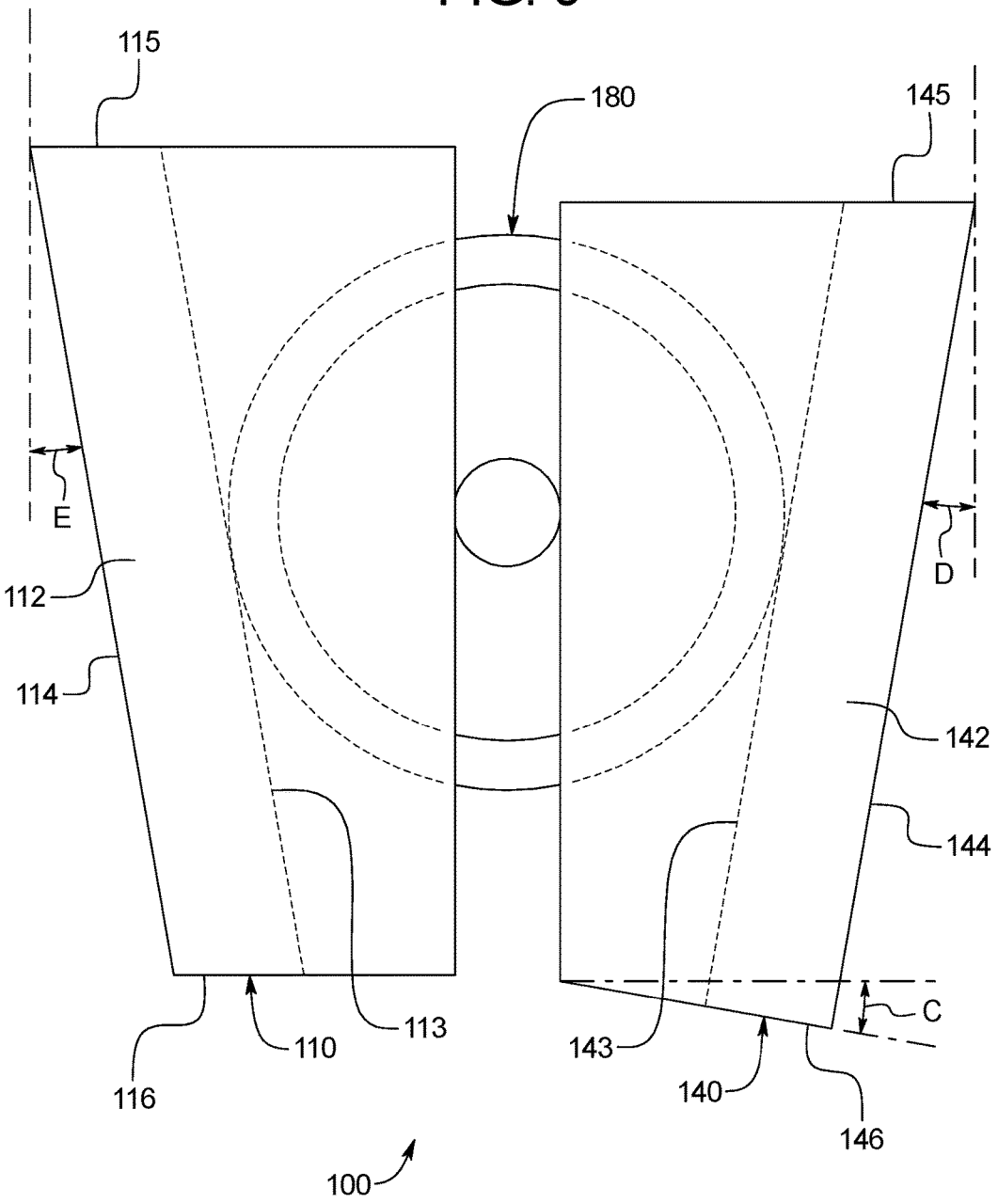
FIG. 9 is an enlarged side view of one of the warp restraints of the freight railroad car truck of FIG. 3A, wherein the walls of the opposing bearing races are shown in phantom and with the roller partially shown in phantom.
Figure 10:
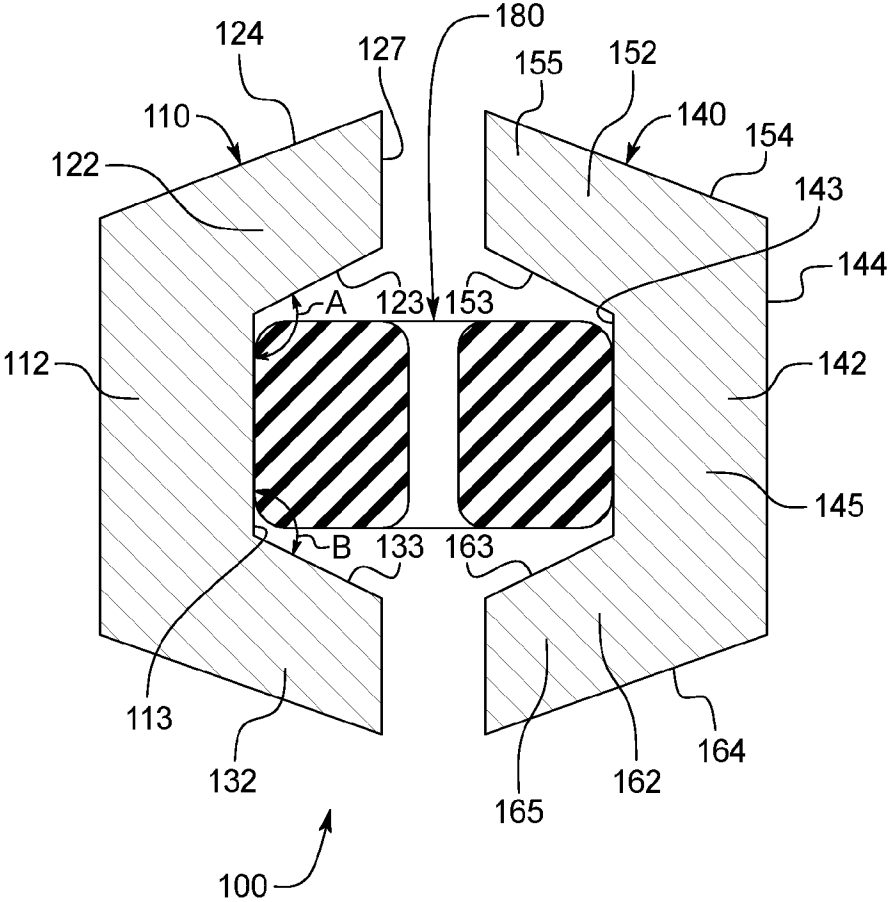
FIG. 10 is an enlarged diagrammatic cross-sectional view of one of the warp restraints of the freight railroad car truck of FIG. 3A, generally illustrating the opposing bearing races and the roller shown in a normal position.

As best shown in FIGS. 5, 9, and 10, the first inner bearing race 110 includes a central wall 112, an inner or first side wall 122 integrally connected to and extending from the central wall 112, and an outer or second side wall 132 integrally connected to and extending from the central wall 112. The central wall 112 includes an inner downwardly angled surface 113, an outer downwardly angled surface 114 (offset from a vertical plane by acute angle E shown in FIG. 9), a top surface 115, and a bottom surface 116. The inner or first side wall 122 includes an inner downwardly angled surface 123, an outer downwardly angled surface 124, a top surface (not labeled), a bottom surface (not labeled), an outer side 127, and an inner side (not labeled). The inner side (not labeled) is integrally formed with or connected to the outer side (not labeled) of the central wall 112 such that the inner or first side wall 122 extends at a first angle A (shown in FIG. 10) relative to the central wall 112. In various embodiments, first angle A may be obtuse, acute, or right. The outer or second side wall 132 includes an inner downwardly angled surface 133, an outer downwardly angled surface (not labeled), a top surface (not labeled), a bottom surface (not labeled), an outer side (not labeled), and an inner side (not labeled). The inner side (not labeled) is integrally formed with or connected to the inner side of the central wall 112 such that the outer or second side wall 132 extends at a second angle B (shown in FIG. 10) relative to the central wall 112. In various embodiments, second angle B may be obtuse, acute, or right. The first angle A and the second angle B may be the same in certain embodiments, and can be different in other embodiments. The central wall 112, the inner or first side wall 122, and the outer or second side wall 132 form a somewhat C-shaped channel (when viewed from the top) configured to receive part of the roller 180.

Similarly, as best shown in FIGS. 5, 9, and 10, the second outer bearing race 140 includes a central wall 142, an inner or first side wall 152 integrally connected to and extending from the central wall 142, and an outer or second side wall 162 integrally connected to and extending from the central wall 142. The central wall 142 includes an inner downwardly angled surface 143, an outer downwardly angled surface 144, a top surface 145, a bottom surface 146, an outer side (not labeled), and an inner side (not labeled). The inner or first side wall 152 includes an inner downwardly angled surface 153, an outer downwardly angled surface 154, a top surface 155, and a bottom surface (not labeled). The outer or second side wall 162 includes an inner downwardly angled surface 163, an outer downwardly angled surface 164, a top surface 165, and a bottom surface (not labeled). The central wall 142, the inner or first side wall 152, and the outer or second side wall 162 form a somewhat C-shaped channel (when viewed from the top) configured to receive part of the roller 180.

The first inner bearing race 110 and the second opposing outer bearing race 140 also form a V-shaped channel (when viewed from the side as best shown in FIG. 9) configured to receive the roller 180. The V-shaped channel extending longitudinally (i.e., along the direction of movement of the truck). The V-shaped channel is wider in the longitudinal direction at the top (i.e., at or adjacent to the top surfaces 115, 145, 155, and 165 of the walls 112, 122, 132, 142, 152, and 162) and is narrower in the longitudinal direction at the bottom (i.e., at or adjacent to the bottom surfaces 116 and 146 of the walls 112, 122, 132, 142, 152, and 162). In certain embodiments, the slopes of the surfaces forming the V-shaped channel are not identical (i.e., the V-shape is not perfect), but in other embodiments the slopes of the surfaces are identical (i.e., the V-shape is substantially perfect). In certain embodiments, the top surfaces of the inner bearing races 110, for example, may be higher than the top surfaces of the outer bearing races 140, for example.

In certain embodiments, the slope of the bottom surfaces 146 of the outer bearing races 140, for example, may be at an angle C (shown in FIG. 9) relative to the slope of the bottom surfaces, 116, for example, of the inner bearing races, 110, for example. In certain embodiments, the slope of the bottom surfaces is perpendicular to the vertical direction. In other embodiments the slope of the bottom surfaces is not perpendicular to the vertical direction. As shown in FIG. 9, the downwardly angled surfaces, 144, for example, of the outer bearing races, 140, for example, may slope at an angle D (shown in FIG. 9) relative to the vertical direction or plane. Similarly, the outer surfaces, 114, for example, of the inner bearing races, 110, for example, may be at an angle E relative to the vertical direction. In certain embodiments, angles D and E are equal. In other embodiments, angle D is greater than angle E. In additional embodiments, angle E is greater than angle D. The angles and relative slopes of the features may vary by warp restraint. Alternatively, they may be identical across the warp restraints.

It should be appreciated that in various embodiments, one or more members (that may or may not include one or more springs) will be employed to maintain the roller in the V-shaped channel.

It should also be appreciated that in various embodiments, one or more of the walls of the bearing races may be formed with one or more protrusions or inwardly protruding members employed to maintain the roller in the V-shaped channel.

It should also be appreciated that in other alternative embodiments, the channel is inverted such that it is wider at the bottom. In such alternative embodiments, one or more members (that may or may not include one or more springs) will be employed to maintain the roller in the channel.

It should further be appreciated that in other alternative embodiments, the walls of the channel are parallel or substantially parallel, and that one or more members (that may or may not include one or more springs) will be employed to maintain the roller in the channel.

The configuration of the warp restraint 100, and specifically the configuration of the first inner bearing race 110, the second opposing outer bearing race 140, and the roller 180 positioned in a channel formed by and between the first and second opposing bearing races 110 and 140 bias or co-act to provide biasing forces on the bolster 40 and the side frame 60 toward the normal square position to reduce, inhibit, or minimize warping.

Figure 11:
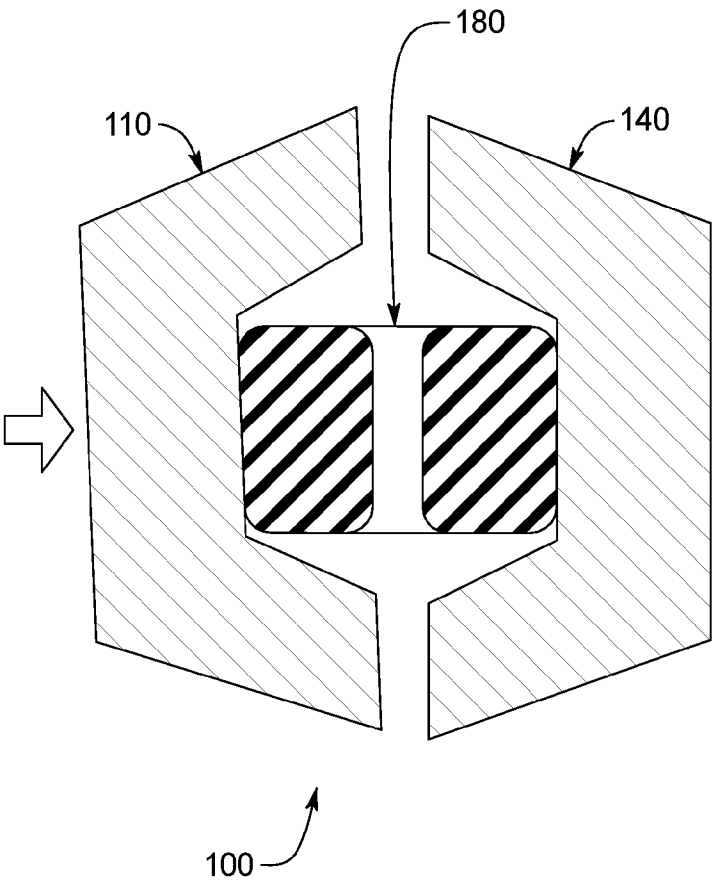
FIG. 11 is an enlarged diagrammatic cross-sectional view of one of the warp restraints of the freight railroad car truck of FIG. 3A, generally diagrammatically illustrating a point in time when the railroad car is in a warped position and that the bearing races have moved closer together such that the roller is compressed and exerts an opposing force on the bearing races.

More specifically, when warping occurs as shown in FIGS. 2 and 3A, the bolster is not square with either of the side frames 60 or 80. Warping is somewhat of a particular combination of forces wherein the each end of the bolster wants to twist inside of the aperture of the respective side frame. The warp restraints 100, 200, 300, 400, 500, 600, 700, and 800 of the present disclosure: (1) independently apply counter biasing forces to the bolster; and (2) apply counter biasing forces to the bolster in transverse groups, wherein such forces act in combination or co-act to cause the bolster to return to its normal position and thus co-act to reduce, inhibit, or minimize warping. If the warping shown on the right end portion of the bolster in FIG. 2 or FIG. 3A occurs to the truck 50 of the present disclosure, the warp restraints 100 and 400 would both act or co-act to apply biasing forces to the right end portion of the bolster 40 to cause the bolster 40 to return to its normal or square position and thus co-act to reduce, inhibit, or minimize warping as generally shown in FIGS. 3B and 11. In other words, the opposite corner rollers 180 and 480 of the opposite corner warp restraints 100 and 400 would be compressed and would exert opposing forces. FIG. 11 shows the two bearing races 110 and 140 moved relatively closer together (as compared to the normal position or distance shown in FIG. 10) and the compressed cylindrical roller 180. The compression of the roller 180 causes the roller 180 to exert opposing forces on the two bearing races 110 and 140 to cause the bearing races 110 and 140 to be biased or to move away from each other and back toward the normal position or distance shown in FIGS. 3A and 10.

Likewise, If the warping shown on the left end of the bolster in FIGS. 2 and 3A occurs to the truck of the present disclosure, the warp restraints 600 and 700 would both act or co-act to apply biasing forces to the left end portion of the bolster 40 to cause the bolster 40 to return to its normal or square position and thus co-act to reduce, inhibit, or minimize warping as shown in FIG. 3B. In other words, the opposite corner rollers 680 and 780 of the opposite corner warp restraints 600 and 700 would be compressed and would exert opposing forces.

It should also be appreciated that if the warping was reversed such that the left side frame 60 was ahead of the right side frame 60 in the truck 50 of the present disclosure, the warp restraints 200 and 300 would both act or co-act to apply biasing forces to the right end portion of the bolster 40 to cause the bolster 40 to return to its normal or square position and thus co-act to reduce, inhibit, or minimize warping. In other words, the opposite corner rollers 280 and 380 of the opposite corner warp restraints 200 and 300 would be compressed and would exert opposing forces.

Likewise, it should also be appreciated that if the warping was reversed such that the left side frame 80 was ahead of the right side frame 60 in the truck 50 of the present disclosure, the warp restraints 500 and 800 would both act or co-act to apply biasing forces to the left end portion of the bolster 40 to cause the bolster 40 to return to its normal or square position and thus co-act to reduce, inhibit, or minimize warping. In other words, the opposite corner rollers 580 and 880 of the opposite corner warp restraints 500 and 800 would be compressed and would exert opposing forces.

The eight warp restraints 100, 200, 300, 400, 500, 600, 700, and 800 of this illustrated example embodiment thus co-act in opposing or transverse groups to bias the bolster toward the square positions relative to the side frames 60 and 80 such that the centerline or center plane of the bolster (that extends transversely relative to straight tracks) is perpendicular or substantially perpendicular to the centerlines or center planes of the respective side frames 60 and 80 (that extend longitudinally relative to straight tracks).

In various embodiments and in various circumstances, the eight warp restraints 100, 200, 300, 400, 500, 600, 700, and 800 may also act to provide other biasing forces to the bolster relative to the side frames and/or may co-act with one or more other components of the railroad car truck to provide other biasing forces to the bolster relative to the side frames. These other biasing effects of the warp restraints of the present disclosure can be considered as secondary potential biasing effects.

More specifically, known prior art railroad cars trucks typically generally have bolsters that have free lateral or transverse movement relative to the side frames of around +/−½ inches, where the end of that lateral or transverse travel is limited by or arrested by stopping members that are often called "Gibs". Gibs are the physical blocks that prevent movement beyond this travel allowance. These Gibs are generally shown in FIG. 2 (in the 8 regions that are taken over by the warp restraints 100, 200, 300, 400, 500, 600, 700, and 800 shown in FIGS. 3A, 3B, and 4).

In the case where the warp restraints of the present disclosure replace the Gibs, the outer walls of the bearing races can perform the function of the Gibs. In the case where the warp restraints of the present disclosure do not replace the Gibs, the warp restraints will allow for limited lateral movement of the bolster relative to the side frames. In certain embodiments, depending upon: (a) the position, shape, and angles of the bearing races; and (b) the shape, size, and elasticity of the rollers, the warp restraints may assist or help to limit the lateral movement of the bolster relative to the side frames.

Figure 12:
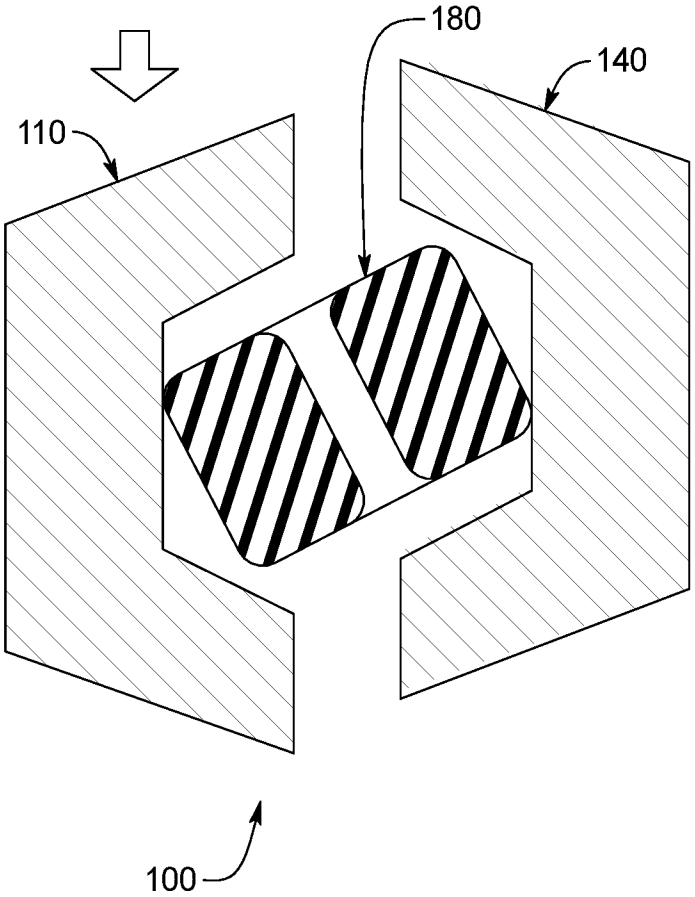
FIG. 12 is an enlarged diagrammatic cross-sectional view of one of the warp restraints of the freight railroad car truck of FIG. 3A, generally diagrammatically illustrating a point in time when the bolster has moved laterally relative to the side frame, and generally illustrating that the roller may or may not exert lateral forces on the bearing races in such circumstances.

In another example of possible secondary biasing forces provided by the warp restraints of the present disclosure, the warp restraints 100, 200, 300, 400, 500, 600, 700, and 800 may co-act with the springs or spring groups of the truck to provide other biasing forces to the bolster relative to the side frames. The lateral or transverse movement of the bolster relative to the side frames is partially controlled by the equilibrium preference of the spring group on which the bolster rides. In other words, the spring groups provide lateral as well as vertical elasticity to the interaction between the bolster and the springs. More specifically, in certain embodiments of the warp restraints such as the embodiments with purely cylindrical rollers such as shown in FIGS. 4, 5, 6, 7, 8, 9, 10, 11, and 12, lateral biasing forces (beyond that provided by the spring group) are expected to be produced. In other words, a purely cylindrical roller (even with slight rounds at the corners as shown in FIG. 12) will likely produce significant lateral biasing forces because such purely cylindrical rollers will not easily roll laterally (as opposed to more rounded rollers). In practice, such a pure cylindrical roller may gradually be worn into a shape approximating the truncated, prolate spheroid shown in FIGS. 13 and 14. In such case, the resistance to lateral movement of the bolster relative to the side frame would decrease as such wear increases.

This is generally shown in FIG. 12 where the purely cylindrical roller does not readily roll and thus resists lateral movement of bearing race 140 with respect to bearing race 110. After a certain amount of lateral movement, the sides (i.e., the non-rolling surface faces) of the roller may become pinched between opposing lateral walls of the opposing bearing race and further limit or arrest lateral motion of the bolster relative to the side frame in a somewhat Gib-like manner.

Figure 14:
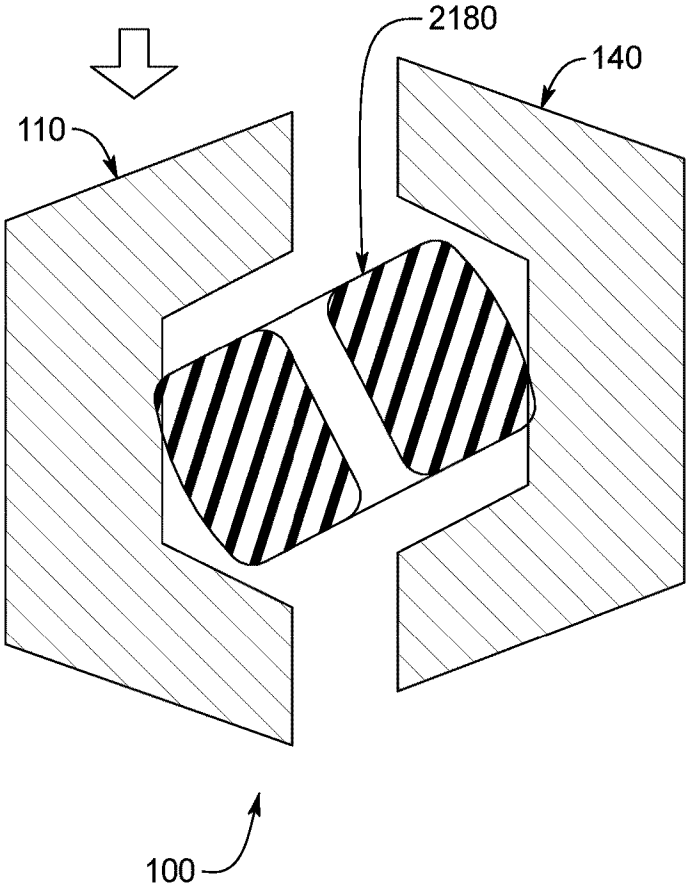
FIG. 14 is an enlarged diagrammatic cross-sectional view of one of the warp restraints of the freight railroad car truck of FIG. 13, generally diagrammatically illustrating a point in time when the bolster has moved laterally relative to the side frame, and generally illustrating that the roller may exert additional lateral forces on the bearing races in such circumstances.
Figure 13:
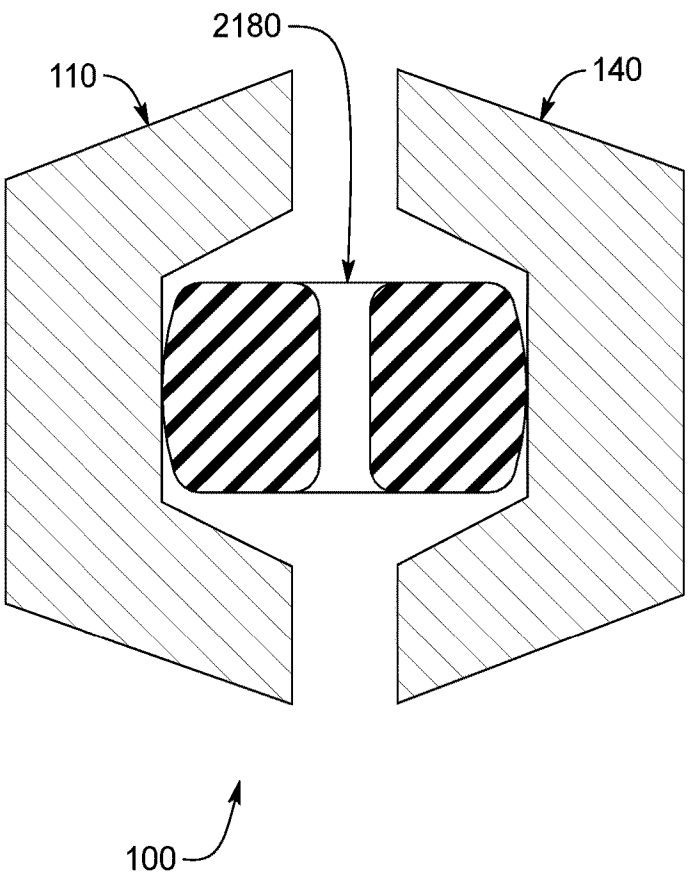
FIG. 13 is an enlarged diagrammatic cross-sectional view of one of the warp restraints of the freight railroad car truck of the present disclosure, generally illustrating an alternative roller that is more like a truncated sphere.

In other embodiments of the present disclosure where the rollers are not purely cylindrical, but rather are more curved or radiused such as the alternative embodiment roller 2180 shown in FIGS. 13 and 14, the rolling faces of the roller are more rounded and can also be deformed (elastically) and/or the bearing race support structure will deform (elastically), and thus be expected to provide certain lateral center-biasing action as somewhat shown in FIG. 14 (which is in addition to lateral centering forces provided by the spring groups). It should be appreciated that the rounded or spherical section of this alternative roller 2180 enables more controlled lateral movement of the end portion of the bolster in or relative to the respective side frame, by rolling along an axis perpendicular to the main, generally cylindrical axis of the roller. This movement is ancillary to the vertical movement of the suspension components, during which the roller would rotate about its primary axis. It should thus be appreciated that the amount of resistance to lateral movement of the bolster relative to the side frames that is provided by the warp restraints of the present disclosure can be in part controlled by the shape of the roller.

Thus, in certain circumstances and certain embodiments of the present disclosure, if the bolster 40 moves laterally or transversely outwardly relative to the side frame 60, the warp restraints may be expected to exert certain biasing forces on those respective bearing races that will in turn transfer such forces to the bolster 40 and the side frame 60 to cause the bolster 40 to move in an opposite direction laterally or transversely inwardly relative to the side frame 60 and return to its normal position. Likewise, in certain circumstances and embodiments of the present disclosure, if the bolster 40 moves laterally or transversely inwardly relative to the side frame 60, the warp restraints may be expected to exert certain biasing forces on those respective bearing races that will in turn transfer such forces to the bolster 40 and the side frame 60 to cause the bolster 40 to move in an opposite direction laterally or transversely outwardly relative to the side frame 60 and return to its normal position.

The warp restraints of certain embodiments of the present disclosure can also reduce, inhibit, or minimize longitudinally movement of the bolsters relative to the side frames depending upon: (a) the shape and angles of the bearing races; and (b) the shape, size, and elasticity of the rollers. For example, if the bolster 40 begins to move forward longitudinally relative to the side frame 60, the roller 180 between the bearing races 110 and 140 will be squeezed and may be expected to exert biasing forces on those respective bearing races 110 and 140, that will in turn transfer such forces to the bolster 40 and the side frame 60 to cause the bolster 40 to move in an opposite direction rearwardly longitudinally relative to the side frame 60 and return to its normal position. Likewise, if the bolster 40 begins to move rearward longitudinally relative to the side frame 60, the roller 280 between the bearing races 210 and 240 will be squeezed and may be expected to exert biasing forces on those respective bearing races 210 and 240 that will in turn transfer such forces to the bolster 40 and the side frame 60 to cause the bolster 40 to move in an opposite direction forwardly longitudinally relative to the side frame 60 and return to its normal position.

It should also be appreciated that most movements of the bolster 40 relative to the side frames 60 and 80 will likely be in a direction that may be a combination of different directions. In such cases, the warp restraints 100, 200, 300, 400, 500, 600, 700, and 800 can act in combination or co-act with one or more other components of the truck to cause the bolster 40 and side frames 60 and 80 to move in opposing directions to return to their normal positions thus co-act to reduce, inhibit, or minimize warping while also possibly applying other additional secondary forces as explained above.

Additionally, it should be appreciated that the warp restraints of the present disclosure can be employed to take up clearance between the side frame and bolster, thereby producing more resistance to truck warping.

In various embodiments, the rollers are made of a suitable material with lower hardness than the truck castings (e.g., the side frame and bolster castings), and such that the rollers are somewhat sacrificial. It is expected that these sacrificial rollers will need to be replaced periodically once substantial wear of the roller has reduced the effectiveness of that roller.

In the illustrated embodiment of FIGS. 3A, 3B, 4, 5, 6, 7, 8, 9, 10, 11, and 12 each roller is purely cylindrical with somewhat rounded edges. In this illustrated embodiment, the cylindrical roller facilitates vertical motion of the bolster relative to the side frame by rolling about the central laterally extending axis of the roller. As mentioned above, this cylindrical roller provides certain resistance or bias against lateral movement (as generally shown in FIG. 12) since it does not roll perpendicular to its central laterally extending axis. In certain instances with such a purely cylindrical roller, the lateral movement of the bolster relative to the side frames may be resisted to an undesirable degree (or, more likely, the roller would be damaged by the forces at play, and become more radiused over time or have its radius increase over time).

Thus, it should be appreciated that the roller employed in certain preferred embodiments of the present disclosure will likely be generally cylindrical with rounded or radiused edges such as the roller 2180 shown in FIGS. 13 and 14. This illustrated roller is formed with a more rounded configuration (like a truncated sphere or sphere with its sides cut off). In other words, each roller may have a rounded, radius, or curved outer bearing race engagement surface. As generally shown in FIGS. 13 and 14, the roller is expected to provide more resistance against lateral movement of the bolster relative to the side frames. FIG. 14 illustrates the cylindrical roller with the rounded, radius, or curved outer bearing race engagement surface in a somewhat laterally displaced position when the bolster has moved laterally relative to the side frame. Depending on the various sizes and configuration of the bearing races and the rollers, the interference resulting from this lateral displacement can cause some elastic deflection or deformation of this roller. The interference resulting from the lateral displacement can also cause deflection of one or both of the bearing races. Such reactions will tend to provide a biasing force on the bearing races that cause the bearing races and roller to return to the centered position. This is considered to be a secondary effect provided by the warp restraints that may not occur in each configuration of the present disclosure.

As mentioned above, it should be appreciated that the rollers of the warp restraints may be differently formed and in particular the rollers may not be cylindrical (as shown in FIGS. 3A, to 12) or have truncated spherical shape (as shown in FIGS. 13 and 14) in the above described illustrated embodiments. The rollers may have different roller sizes such as roller diameters, roller thicknesses or widths, roller elasticity or spring characteristics, and roller shapes. For example, in certain alternative example embodiments of the present disclosure, the rollers can be: (a) oval or oblong; (b) oblate like a flattened ball with a cross section not perfectly circular; (c) prolate spherical like an American football; (d) prolate spherical like an American football with both ends cut off; or (e) a vertically extending cylinder.

In other example embodiments of the present disclosure, the roller is in the form of a spherical ball. In the spherical ball alternative shape, the roller facilitates vertical motion of the bolster relative to the side frame by rolling about the central laterally extending axis of the roller. This alternative roller also provides a certain amount of resistance or bias against lateral movement since it can roll perpendicular to its central laterally extending axis. In certain instances, this would be functionally less ideal since the Gib function at the end of the lateral travel would be reduced to point contacts.

In other alternative example embodiments of the present disclosure, the rollers are trapezoidal shaped or triangular, wherein the tapered or narrower end is positioned toward the bottom sections of the bearing races and the wider end is positioned toward the top sections of the bearing races. In such embodiments, the rollers can be made from a relatively hard plastic material with self-lubricating characteristics such as from a DELRIN material.

It should further be appreciated that over the expected life of each roller or as each roller wears, it is expected that the diameter of the roller will decrease due to: (1) abrasion against the surfaces upon which the roller rolls (i.e., the surfaces of the bearing races); (2) plastic deformation of the roller due to compression; (3) corrosion; and/or (4) other degenerative processes. In the case of vertical, finite, reciprocal motion, this reduction in roller diameter is accounted for by aligning the bearing race surfaces at slight inward angles relative to the direction of displacement. Thus, as the roller diameter becomes smaller, the roller proceeds along the line of action as the distance between the contact points between each bearing race and the roller surface tend to become nearer. In other words, as the roller becomes smaller, its axis of rotation relative to the bearing race will be relatively lower or closer to the tracks or rails, and thus provide substantially the same relative forces on the bearing races. In such cases, the worn roller (such as the roller shown in FIG. 9) may sit lower in the V-shaped channel (than the roller partially shown in phantom in FIG. 9).

It should also be appreciated that as the roller wears down, the rounded, radius, or curved outer bearing race engagement surface of the roller (such as the roller in FIGS. 13 and 14) may vary, and particularly may be somewhat flattened. It should also be appreciated that the present disclosure provides pairs of opposing bearing races with opposed slopes, and that the configuration of the warp restraints and specifically the pairs of opposing bearing races with opposed slopes, enable the roller outer surface to wear, while retaining the core function of full contact at essentially all times. In other words, if the roller is somewhat flattened, it may sit lower in the V-shaped channel between the bearing races and still operate to provide its primary biasing forces against warping. However, in such wear conditions, it may provide different secondary biasing forces against lateral bolster movement.

It should further be appreciated that the warp restraints of the present disclosure require relatively little material to provide additional stiffness.

It should be appreciated that in various embodiments, one or more of the surfaces of the bearing race do not need any lubrication.

It should be appreciated that in various embodiments, one or more of the surfaces of the bearing race are self-lubricating.

Figure 15:
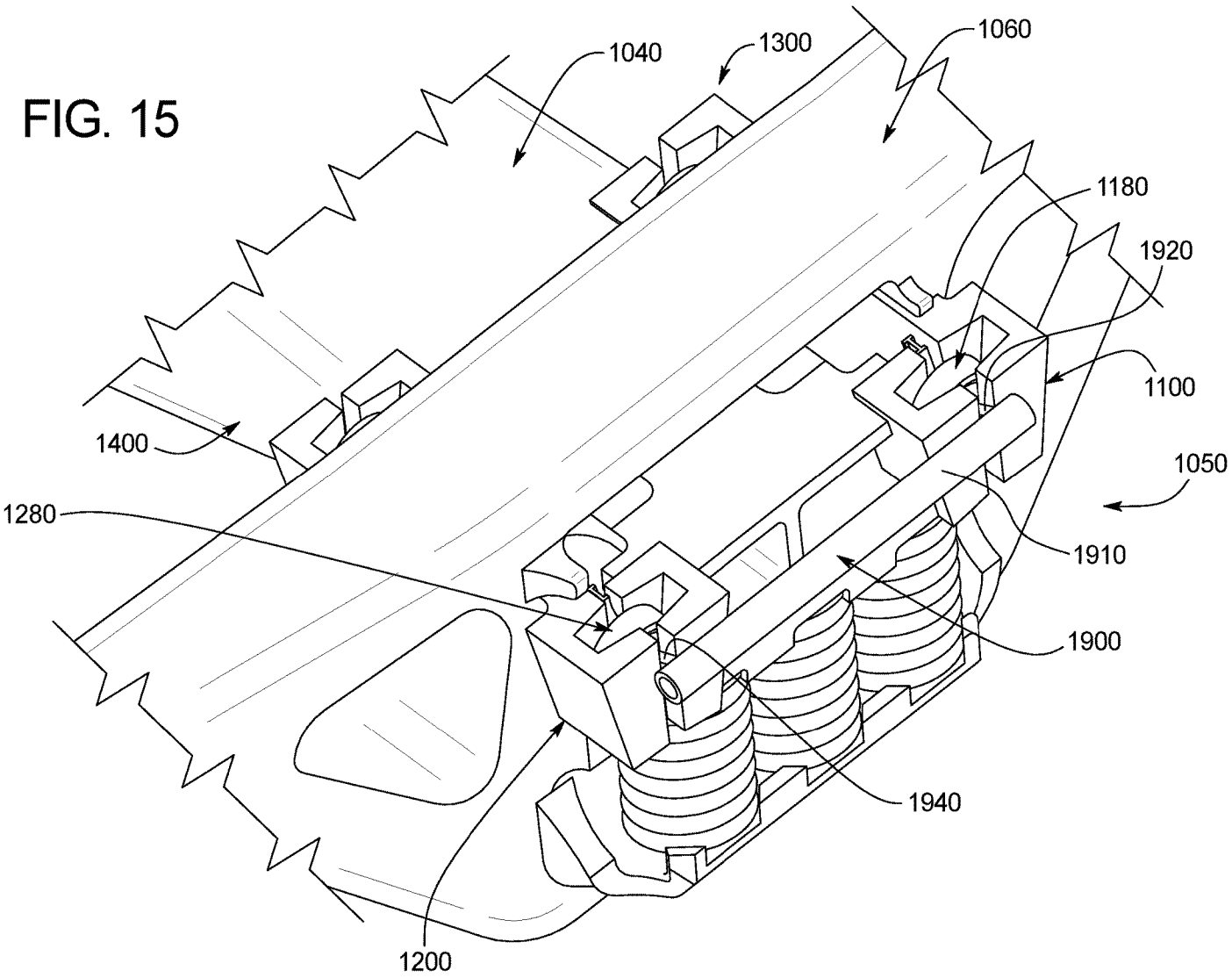
FIG. 15 is a fragmentary perspective view of an end portion of the bolster, a first one of the side frames, and a first one of the sets of the warp restraints of another embodiment of the freight railroad car truck of the present disclosure, that additionally includes a torsion bar connecting two of the rollers of two of the warp restraints.
Figure 16:
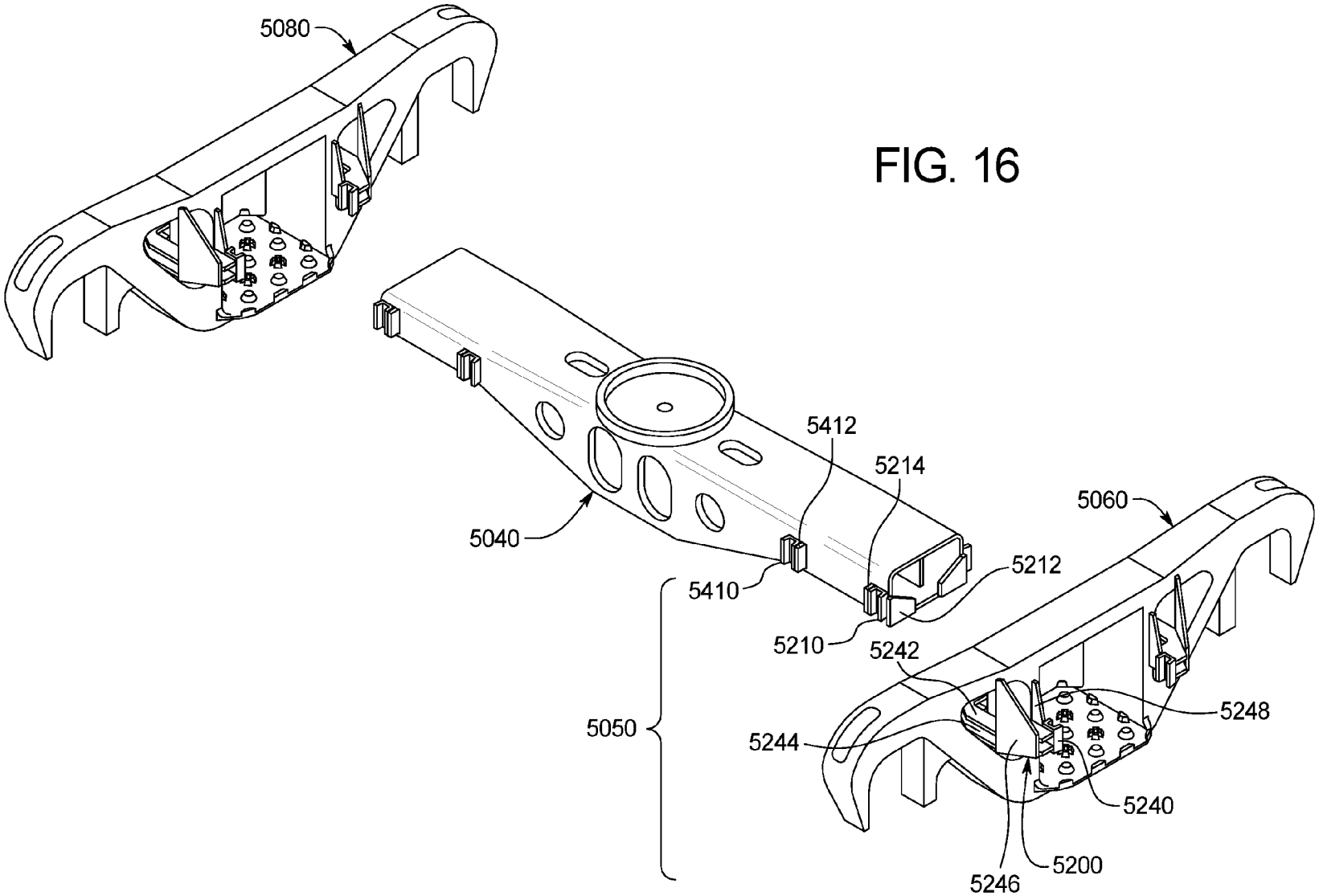
FIG. 16 is an exploded top perspective view of the bolster, two side frames, and the warp restraints of the freight railroad car truck of another example embodiment of the freight railroad car truck with warp restraints of the present disclosure.

Referring now to the FIG. 15, the railroad car truck of the present disclosure that is generally indicated by numeral 1050 is shown and includes an additional feature. In this illustrated example embodiment of the present disclosure, the railroad car truck 1050 includes a bolster 1040, a first side frame 1060, and a second side frame (not shown). In this illustrated example embodiment of the present disclosure, the railroad car truck 1050 includes: (1) a first plurality or set of warp restraints 1100, 1200, 1300, and 1400; and (2) a second plurality or set of warp restraints (not shown). The railroad truck car truck 1050 includes a torsion bar 1900 connecting the roller 1180 and 1280 of the warp restraints 1100 and 1200.

In this illustrated embodiment, the torsion bar 1900 includes a tubular body 1910 and two spaced apart arms 1920 and 1940. One end of arm 1920 is connected to the tubular body 1910 and the opposite end is connected to roller 1180. Likewise, one end of arm 1940 is connected to the tubular body 1910 and the opposite end is connected to roller 1280. It should be appreciated that any suitable connectors may be employed in accordance with the present disclosure. The torsion bar 1900 is configured to assist in automatically returning the roller 1180 and 1280 to equal vertical alignment that in turn assists in forcing the bolster back to the center or central position.

In this alternative embodiment, to further reduce, inhibit, or minimize warping, pairs of rollers are employed. Each individual roller of a roller pair is allowed to move vertically in an independent manner, and under certain circumstances is forced to be re-aligned with one another. The torsion bar is provided to enable ongoing independent movement as needed, while also assuring that both rollers return to their nominal relative alignment.

If the railroad car truck with the warp restraints manages (against considerable resistance from the rollers) to become displaced into a warped condition where the rollers actually tend to retain the truck in that warped configuration, the torsion bars will function to cause the rollers to return to their desired positions.

Referring now to FIGS. 16, 17, 18 and 19, another example embodiment of the railroad car truck with warp restraints of the present disclosure is generally shown and indicated by numeral 5050. In this illustrated example embodiment of the present disclosure, the truck 5050 includes a bolster 5040, a first side frame 5060, and a second side frame 5080. This illustrated example embodiment generally shows alternative connectors for connecting the bearing races to the side frames 5060 and 5080 and to the bolster 5040. It should be appreciated as stated above that any suitable connectors can be employed to connect the bearing races to the side frames and the bolster in accordance with the present disclosure.

Like the above embodiment, in this illustrated example embodiment of the present disclosure, the railroad car truck with warp restraints 5050 includes: (1) a first plurality or set of warp restraints (which are only partially shown); and (2) a second plurality or set of warp restraints (which are only partially shown). Only warp restraints 5200 and 5400 are discussed herein as examples of the inner and outer warp restraints of this alternative example embodiment of the present disclosure.

More specifically, in this illustrated embodiment, (a) example warp restraint 5200 includes a first inner bearing race 5210 integrally formed at and extending from the first end portion of the bolster 5040, a second opposing outer bearing race 5240 integrally formed at and extending from the first side frame 5060, and a roller 5280 positioned in a channel formed by and between the first and second opposing bearing races 5210 and 5240; and (b) warp restraint 5400 includes a first inner bearing race 5410 integrally formed at and extending from the first end portion of the bolster 5040, a second opposing outer bearing race 5440 integrally formed at and extending from the first side frame 5060, and a roller 5480 positioned in a channel formed by and between the first and second opposing bearing races 5410 and 5440. Thus, other warp restraints of this alternative example embodiment are similarly formed as these warp restraints.

In this illustrated example embodiment, the first inner bearing race 5210 of warp restraint 5200 is connected to the first end portion of the bolster 5040 by generally or substantially vertically extending race bearing side connectors 5212 and 5214 that are each integrally connected by welding to the bolster 5040 and to opposite outer surfaces of the opposing side walls of the bearing race 5210.

Figure 17:
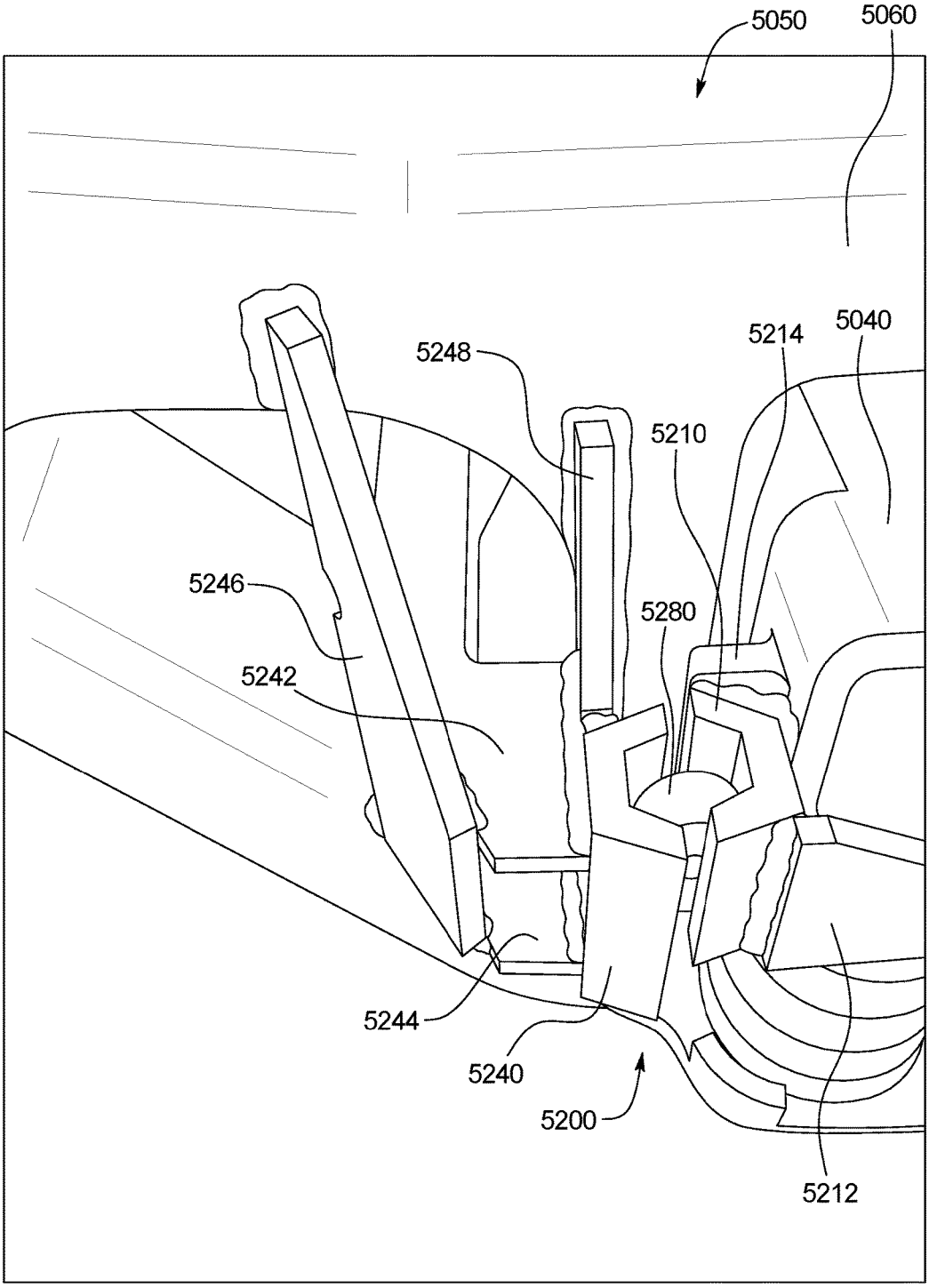
FIG. 17 is an enlarged fragmentary top perspective view of one end portion of the bolster, a first one of the side frames, and one of the warp restraints of FIG. 16.
Figure 18:
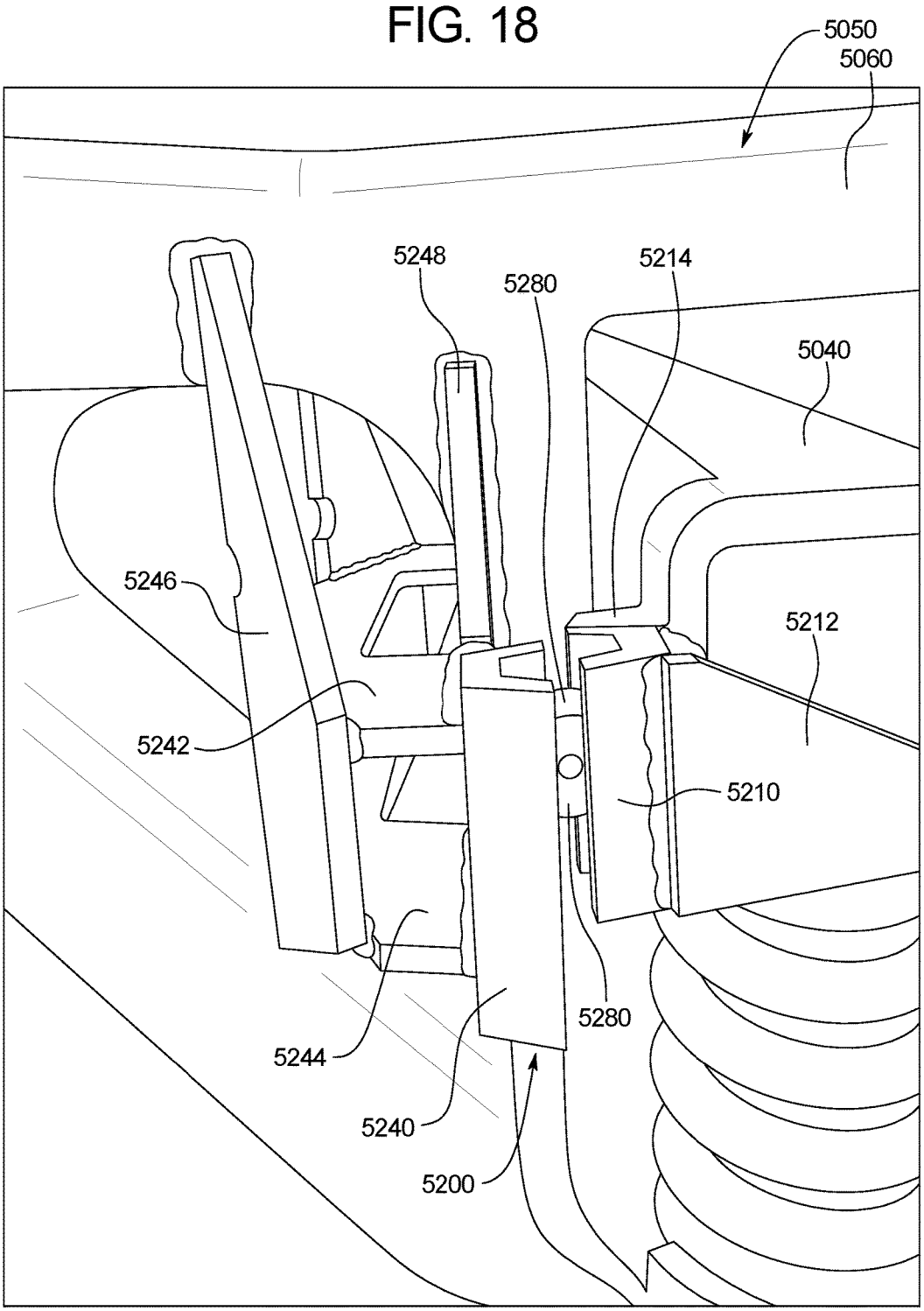
FIG. 18 is an enlarged fragmentary side perspective view of one end portion of the bolster, a first one of the side frames, and one of the warp restraints of FIG. 16.

In this illustrated example embodiment (as best shown in FIGS. 17 and 18), the second outer bearing race 5240 of warp restraint 5200 is connected to the first side frame 5060 by a generally or substantially vertically extending race bearing side connector 5248 integrally connected by welding to the side frame 5060 and to the outer surface of the inner side wall of the bearing race 5240. In this illustrated example embodiment, the second outer bearing race 5240 of warp restraint 5200 is also connected to the first side frame 5060 by two spaced apart generally or substantially horizontally extending race bearing side connectors 5242 and 5244 integrally connected by welding to the side frame 5060 and to outer surface of the center wall of the bearing race 5240. In this illustrated example embodiment, an additional angled race bearing side connector 5246 is integrally connected by welding to the side frame 5060 and to the race bearing side connectors 5242 and 5244.

Figure 19:
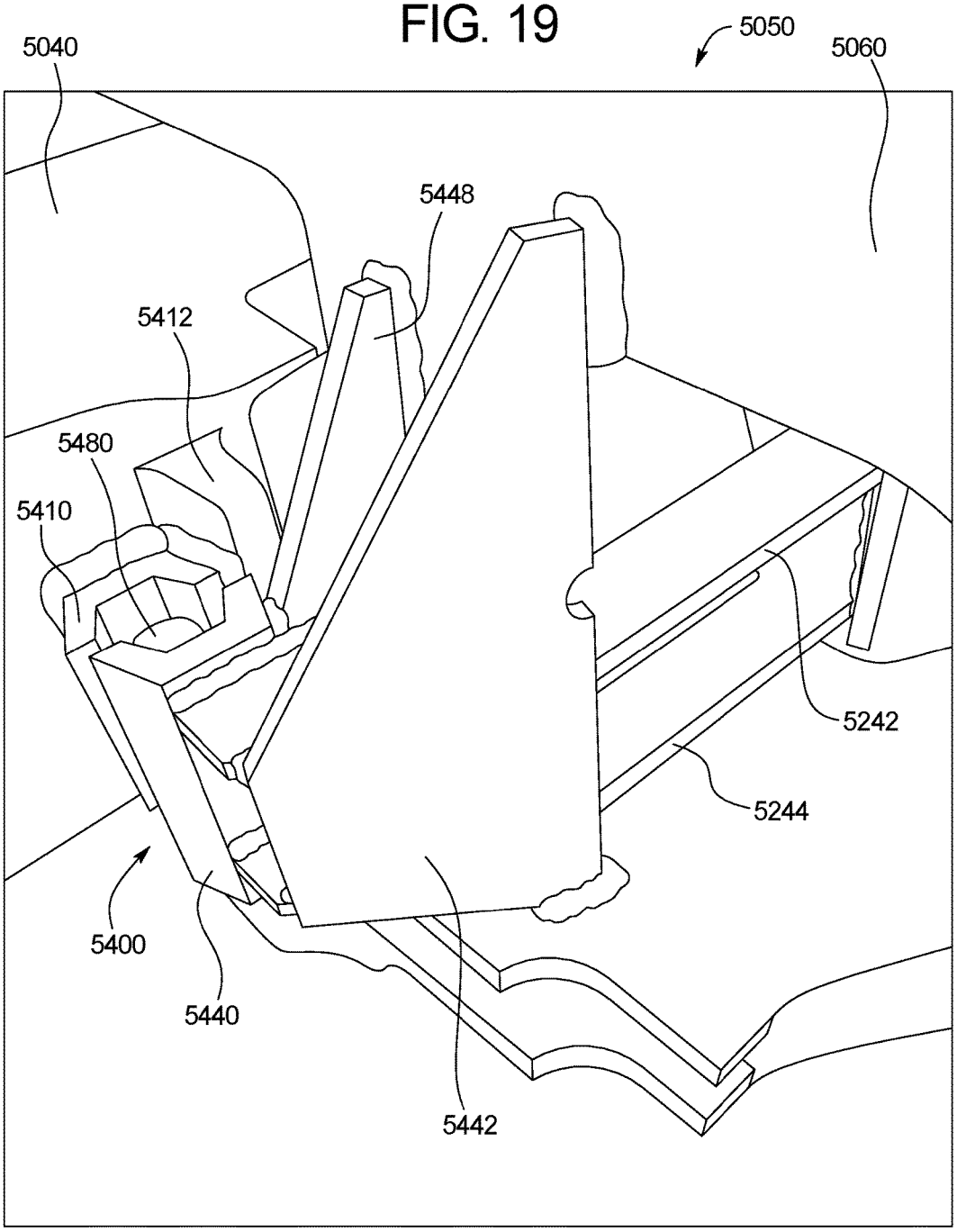
FIG. 19 is an enlarged fragmentary side perspective view of the inner end portion of the bolster, a first one of the side frames, and another one of the warp restraints of FIG. 16.

In this illustrated example embodiment (as best shown in FIG. 19), the first inner bearing race 5410 of warp restraint 5400 is connected to the first end portion of the bolster 5040 by generally or substantially vertically extending race bearing side connector 5412 that is integrally connected by welding to the bolster 5040 and outer side wall of the bearing race 5410.

In this illustrated example embodiment, the second outer bearing race 5440 of warp restraint 5400 is connected to the first side frame 5060 by a generally or substantially vertically extending race bearing side connector 5448 integrally connected by welding to the side frame 5060 and to outer surface of the outer side wall of the bearing race 5440. In this illustrated example embodiment, the second outer bearing race 5440 of warp restraint 5400 is also connected to the first side frame 5060 by the two spaced apart generally or substantially horizontally extending race bearing side connectors 5242 and 5244 integrally connected by welding to the side frame 5060 and to outer surface of the center wall of the bearing race 5440. In this illustrated example embodiment, an additional angled race bearing side connector 5442 is integrally connected by welding to the side frame 5060 and to the race bearing side connectors 5242 and 5244.

It should be appreciated from above and from the example embodiment of FIGS. 16, 17, 18, and 19, that in various alternative embodiments of the present disclosure, the two opposing bearing races can have different heights to facilitate different ranges of motion of the two opposing bearing races (and the respective side frame and bolster).

It should also be appreciated from above that in various alternative embodiments of the present disclosure, the angles of the channels and the outer diameters of the respective rollers may vary.

It should also be appreciated that in various alternative embodiments of the present disclosure, one or more attachment mechanisms such as one or more hooks (not shown) can be attached to the roller to maintain the roller between the two opposing bearing races.

It should further be appreciated that in various alternative embodiments of the present disclosure, one or more of the rollers are trapezoidal shaped (not shown) or are in a trapezoidal shape form (not shown) that is positioned between the two opposing bearing races. In certain such embodiments, the trapezoidal member has a smaller width at its bottom portion and tapers to a larger width at its top portion, The taper is continuous in various embodiments and non-continuous in other embodiments. In certain such non-continuous embodiments, the taper is stepped.

It will be understood that modifications and variations may be effected without departing from the scope of the novel concepts of the present invention, and it is understood that this application is to be limited only by the scope of the claims.

The invention is claimed as follows:

1. A railroad car truck comprising:

a first side frame;

a second side frame;

a bolster;

a plurality of first warp restraints positioned at a first end portion of the bolster and the first side frame wherein each of the first warp restraints includes: (a) a first bearing race fixedly connected to the bolster, (b) a second bearing race fixedly connected to the first side frame, and (c) a roller positioned in a channel formed between the first bearing race and the second bearing race, wherein the roller has an axis movable with respect to both the first bearing race and the second bearing race; and a plurality of second warp restraints positioned at a second end portion of the bolster and the second side frame, wherein each of the second warp restraints includes: (a) a first bearing race fixedly connected to the bolster, (b) a second bearing race fixedly connected to the second side frame, and (c) a roller positioned in a channel formed between the first bearing race and the second bearing race, wherein the roller has an axis movable with respect to both the first bearing race and the second bearing race.

2. The railroad car truck of claim 1, wherein each channel between the first bearing race and the second bearing race of each warp restraint is substantially V shaped in an upright direction when viewed from a side of the railroad car truck.

3. The railroad car truck of claim 1, wherein each bearing race includes a central wall, an inner side wall integrally connected to and extending at an angle from the central wall, and an outer side wall integrally connected to and extending at an angle from the central wall.

4. The railroad car truck of claim 3, wherein the central wall includes an inner downwardly angled surface.

5. The railroad car truck of claim 3, wherein the central wall, the inner side wall, and the outer side wall form a C-shaped channel when viewed from above the bearing race.

6. The railroad car truck of claim 1, wherein at least one of the bearing races includes a connector integrally connecting the bearing race to the bolster.

7. The railroad car truck of claim 1, wherein at least one of the bearing races includes a connector integrally connecting the bearing race to the first side frame.

8. The railroad car truck of claim 1, wherein at least one of the rollers is cylindrical.

9. The railroad car truck of claim 1, wherein at least one of the rollers has a curved outer circumference.

10. The railroad car truck of claim 1, which includes a first torsion bar connecting two of the rollers of two of the plurality of the first warp restraints.

11. The railroad car truck of claim 10, which includes a second torsion bar connecting two of the rollers of two of the plurality of the second warp restraints.

12. A railroad car truck comprising:

a first side frame;

a second side frame;

a bolster;

a plurality of first warp restraints extending from a first end portion of the bolster and the first side frame; and a plurality of second warp restraints extending from a second end portion of the bolster and the second side frame;

each warp restraint including:

(a) a first bearing race extending from the bolster, (b) a second bearing race extending from a respective one of the side frames, and (c) a roller positioned in a channel formed by and between the first bearing race and the second bearing race, wherein each channel is substantially V shaped in an upright direction when viewed from a side of the railroad car truck.

13. The railroad car truck of claim 12, wherein each bearing race includes a central wall, an inner side wall integrally connected to and extending at an angle from the central wall, and an outer side wall integrally connected to and extending at an angle from the central wall.

14. The railroad car truck of claim 13, wherein the central wall includes an inner downwardly angled surface.

15. The railroad car truck of claim 13, wherein the central wall, the inner side wall, and the outer side wall form a C-shaped channel when viewed from above the bearing race.

16. The railroad car truck of claim 12, wherein at least one of the bearing races includes a connector integrally connecting the bearing race to the bolster.

17. The railroad car truck of claim 12, wherein at least one of the bearing races includes a connector integrally connecting the bearing race to the first side frame.

18. The railroad car truck of claim 12, wherein each bearing race that is connected to the second side frame includes a connector connecting the bearing race to the second side frame.

19. The railroad car truck of claim 12, wherein at least one of the rollers is cylindrical.

20. The railroad car truck of claim 12, wherein at least one of the rollers has a curved outer circumference.

21. The railroad car truck of claim 12, which includes a first torsion bar connecting two of the rollers of two of the plurality of first warp restraints.

22. The railroad car truck of claim 21, which includes a second torsion bar connecting two of the rollers of two of the plurality of second warp restraints.

23. A railroad car truck comprising:

a first side frame;

a second side frame;

a bolster;

a first warp restraint including: (a) a first inner bearing race extending from a first end portion of the bolster, and (b) a second opposing outer bearing race extending from the first side frame, the first inner bearing race and the second opposing bearing race of the first warp restraint forming a channel there between, said channel configured to receive a first roller;

a second warp restraint including: (a) a first inner bearing race extending from a second end portion of the bolster, and (b) a second opposing outer bearing race extending from the second side frame, the first inner bearing race and the second opposing bearing race of the second warp restraint forming a channel there between, said channel configured to receive a second roller; and friction wedges and the first and second warp restraints being combined to provide vertical damping.

24. The railroad car truck of claim 23, which includes a third warp restraint including: (a) a first inner bearing race extending from a first end portion of the bolster, and (b) a second opposing outer bearing race extending from the first side frame, the first inner bearing race and the second opposing bearing race of the first warp restraint forming a channel there between, said channel configured to receive a third roller;

a fourth warp restraint including: (a) a first inner bearing race extending from a first end portion of the bolster, and (b) a second opposing outer bearing race extending from the first side frame, the first inner bearing race and the second opposing bearing race of the first warp restraint forming a channel there between, said channel configured to receive a fourth roller; and a fifth warp restraint including: (a) a first inner bearing race extending from a first end portion of the bolster, and (b) a second opposing outer bearing race extending from to the first side frame, the first inner bearing race and the second opposing bearing race of the first warp restraint forming a channel there between, said channel configured to receive a fifth roller.

25. The railroad car truck of claim 24, which includes a sixth warp restraint including: (a) a first inner bearing race extending from a second end portion of the bolster, and (b) a second opposing outer bearing race extending from the second side frame, the first inner bearing race and the second opposing bearing race of the second warp restraint forming a channel there between, said channel configured to receive a sixth roller;

a seventh warp restraint including: (a) a first inner bearing race extending from a second end portion of the bolster, and (b) a second opposing outer bearing race extending from the second side frame, the first inner bearing race and the second opposing bearing race of the second warp restraint forming a channel there between, said channel configured to receive a seventh roller; and an eighth warp restraint including: (a) a first inner bearing race extending from a second end portion of the bolster, and (b) a second opposing outer bearing race extending from the second side frame, the first inner bearing race and the second opposing bearing race of the second warp restraint forming a channel there between, said channel configured to receive an eighth roller.

26. The railroad car truck of claim 23, wherein each bearing race includes a central wall, an inner side wall integrally connected to and extending at an angle from the central wall, and an outer side wall integrally connected to and extending at an angle from the central wall.

27. The railroad car truck of claim 26, wherein each central wall includes an inner downwardly angled surface.

28. The railroad car truck of claim 26, wherein each central wall, each inner side wall, and each outer side wall form a C-shaped channel when viewed from above the bearing race.

29. The railroad car truck of claim 23, wherein at least one of the bearing races includes a connector integrally connecting the bearing race to the bolster.

30. The railroad car truck of claim 23, wherein at least one of the bearing races includes a connector integrally connecting the bearing race to the first side frame.

31. The railroad car truck of claim 23, wherein at least one of the bearing races includes a connector integrally connecting the bearing race to the second side frame.

32. A railroad car truck comprising:

a first side frame;

a second side frame;

a bolster;

a plurality of first warp restraints positioned at a first end portion of the bolster and the first side frame; and a plurality of second warp restraints positioned at a second end portion of the bolster and the second side frame, wherein each warp restraint includes: (a) a first bearing race, (b) a second bearing race, and (c) a roller positioned in a channel formed between the first bearing race and the second bearing race; and a first torsion bar connecting two of the rollers of two of the plurality of first warp restraints.

33. The railroad car truck of claim 32, which includes a second torsion bar connecting two of the rollers of two of the plurality of second warp restraints.

34. A railroad car truck comprising:

a first side frame;

a second side frame;

a bolster;

a plurality of first warp restraints extending from a first end portion of the bolster and the first side frame;

a plurality of second warp restraints extending from a second end portion of the bolster and the second side frame, each warp restraint including:

(a) a first bearing race extending from the bolster, (b) a second bearing race extending from a respective one of the side frames, and (c) a roller positioned in a channel formed by and between the first bearing race and the second bearing race; and a first connector at one of the first and second side frames and having first and second ends interconnecting two of the rollers of two of the plurality of first warp restraints.

35. The railroad car truck of claim 34, which includes a second connector connecting two of the rollers of two of the plurality of second warp restraints.

* * * * *